US008380112B2

(12) United States Patent
Imamura et al.

(10) Patent No.: US 8,380,112 B2
(45) Date of Patent: Feb. 19, 2013

(54) IMAGE FORMING APPARATUS INCLUDING A GRIPPING UNIT

(75) Inventors: Atsushi Imamura, Matsumoto (JP); Yujiro Nomura, Shiojiri (JP); Yoshihisa Saka, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 372 days.

(21) Appl. No.: 12/759,944

(22) Filed: Apr. 14, 2010

(65) Prior Publication Data

US 2010/0260522 A1 Oct. 14, 2010

(30) Foreign Application Priority Data

Apr. 14, 2009 (JP) ..... 2009-097978

(51) Int. Cl.
*G03G 15/01* (2006.01)
*G03G 15/20* (2006.01)

(52) U.S. Cl. ..... 399/304; 399/313

(58) Field of Classification Search ..... 399/302, 399/303, 304, 305, 313, 314; 101/415.1
See application file for complete search history.

(56) References Cited

U.S. PATENT DOCUMENTS

| | | | | | |
|---|---|---|---|---|---|
| 3,612,677 | A | * | 10/1971 | Langdon et al. | 399/304 |
| 4,875,069 | A | * | 10/1989 | Takada et al. | 399/304 |
| 5,016,056 | A | * | 5/1991 | Johnson et al. | 399/304 |
| 5,402,217 | A | * | 3/1995 | Kimura et al. | 399/304 |
| 5,794,530 | A | * | 8/1998 | Dobashi et al. | 101/415.1 X |

FOREIGN PATENT DOCUMENTS

| | | | |
|---|---|---|---|
| JP | 2000-238400 | A | 9/2000 |
| JP | 2009-014808 | A | 1/2009 |

* cited by examiner

*Primary Examiner* — Sandra Brase
(74) *Attorney, Agent, or Firm* — Workman Nydegger

(57) ABSTRACT

An image forming apparatus includes an image carrier which carries an image and a transfer roller including a roller base material which faces the image carrier and rotates. A concave portion is positioned on a peripheral surface of the roller base material. A grip unit on the concave portion grips a recording medium. An elastic layer is disposed on a peripheral surface of the roller base material. The transfer roller passes the recording medium through a nip between the image carrier and the elastic layer which comes into contact with the image carrier via the image carrier and the recording medium to transfer the image carried on the image carrier onto the recording medium. A roller driving unit rotates the roller base material. A control unit controls the roller driving unit and causes the concave portion to face the image carrier to stop the transfer roller.

7 Claims, 15 Drawing Sheets

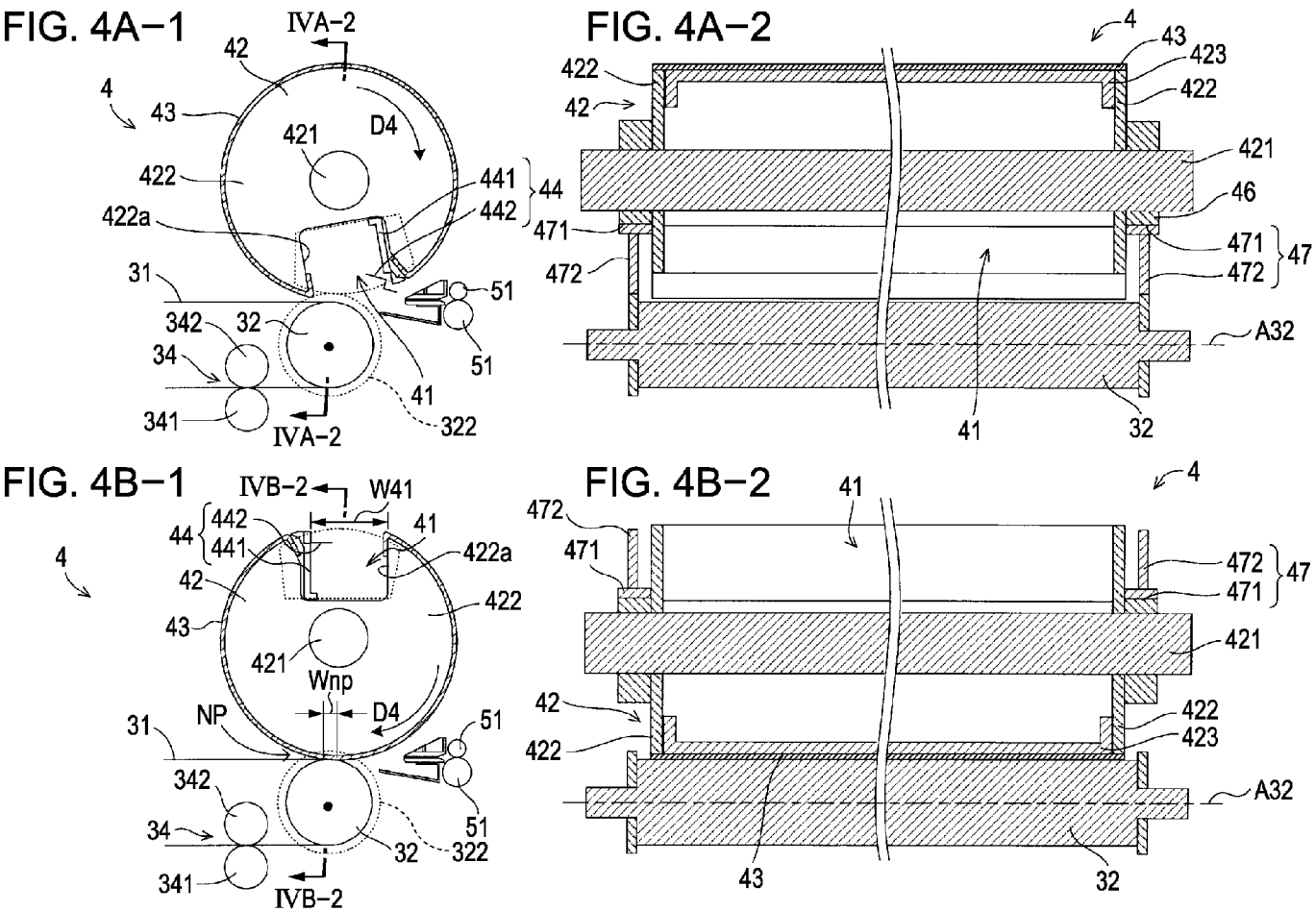
FIG. 4A−1
FIG. 4A−2
FIG. 4B−1
FIG. 4B−2
IVA−2
IVB−2
D4
W41
Wnp
NP
4
41
42
43
44
46
47
51
31
32
34
322
341
342
421
422
422a
423
441
442
471
472
A32

RELATIONSHIP BETWEEN OPERATION AND PHASE OF TRANSFER ROLLER

PHASE B: NIP RELEASE POSITION

PHASE A1, A2: NIP OPEN POSITION

WAITING FOR IMAGE FORMING COMMAND

TRANSPORT START OF RECORDING MEDIUM

START OF PAPER BITING OPERATION

COMPLETION OF PAPER BITING OPERATION

START OF SECONDARY TRANSFER PROCESS

IN SECONDARY TRANSFER PROCESS

RELEASE OF RECORDING MEDIUM

XIB
XIB
4
42
43
91
92
α
D4
422
421
422a
441
442
44
51
51
41
322
31
342
34
341
4
43
423
422
42
421
46
471
472
47
A32
322
32
41
91
921
92
46
471
472
322
M4
MOTOR
91
421
α
921
922
92

FIRST MODIFIED EXAMPLE

SECOND MODIFIED EXAMPLE

THIRD MODIFIED EXAMPLE

IMAGE FORMING APPARATUS INCLUDING A GRIPPING UNIT

BACKGROUND

1. Technical Field

The present invention relates to an image forming apparatus and an image forming method using the apparatus, which is provided with a transfer roller transferring an image formed on an image carrier to a recording medium.

2. Related Art

There is disclosed an image forming apparatus which develops an electrostatic latent image to be visible using a liquid developer with high viscosity in which a toner containing solid content is dispersed into a carrier liquid (for example, refer to JP-A-2009-14808, FIG. 1). In the image forming apparatus, four image forming stations are provided which form images with different colors from each other, and toner images formed by the respect image forming stations are overlapped on an intermediate transfer belt so as to form a color image. The intermediate transfer belt is suspended on a pair of a driving roller and a driven roller which are disposed separately from each other, and drives the driving roller by a belt driving motor so as to move in a predetermined direction while the color image is carried. In addition, a secondary transfer apparatus which is commercially available in a dry image forming apparatus is provided to face the driving roller, the color image is secondarily transferred onto a recording medium such as paper, film or cloth. In other words, in the secondary transfer position, a secondary transfer roller of which an external peripheral surface is covered by an elastic member such as rubber is disposed to face the driving roller with the intermediate transfer belt interposed therebetween, so that a nip is formed between the intermediate transfer belt and the elastic member. Then, by driving the driving roller by a belt driving motor, the intermediate transfer belt is rotated and the secondary transfer roller is rotatably driven with respect to the intermediate transfer belt, and the recording medium is nipped and transported between the nip. During nipping and transporting the recording medium, a color image on the intermediate transfer belt is secondarily transferred onto the recording medium.

Since the apparatus described in JP-A-2009-14808 (FIG. 1) employs a wet scheme using liquid developer, the recording medium passed through the nip is not separated from the intermediate transfer belt, but transported toward the image forming stations in a state of being attached to the intermediate transfer belt, so that so-called paper jam occurs. As one of measures for solving the problem, there is proposed a transfer technique which is used in a stencil printing apparatus. The reason is as follows.

In the stencil printing apparatus, an impression cylinder is provided which is provided with a paper gripper to hold the tip end of paper, and rotates by a driving force applied from a driving unit such as a motor. The impression cylinder as configured above rotates while gripping the tip end of paper by the paper gripper, and pushes the paper with respect to the impression cylinder which winds a proofed master, so that printing is performed by ink (for example, refer to JP-A-2000-238400, FIG. 1). For this reason, in spite of using or not high-viscosity ink is used, the printed paper is not attached to the cylinder, but effectively separated from the cylinder on the downstream side of an attached position. Then, it may be considered that the secondary transfer roller is configured as the impression cylinder as described above, that is, a grip unit may be provided to grip the recording medium in the secondary transfer roller. That is, while the tip end (non-image portion) of the recording medium is gripped by the grip unit, the secondary transfer roller rotates, so that the recording medium passed through the nip can be effectively separated from the intermediate transfer belt, and paper jams can be effectively prevented.

However, when the transfer technique described in JP-A-2000-238400 (FIG. 1) is employed to the image forming apparatus, there may occur a problem such as the degradation in the image quality or the contamination of the rear surface of the recording medium. That is, in the image forming apparatus, an elastic layer such as rubber or resin is formed on an outer peripheral surface of the secondary transfer roller in order to form a nip, and moreover a load (for example, 50 to 100 kgf in case of the image forming apparatus in liquid developing scheme) is applied on the surface of the image carrier such as the intermediate transfer belt or the intermediate transfer drum from the secondary transfer roller. Therefore, when the secondary transfer roller stops in a state in which the elastic layer of the secondary transfer roller comes into contact with the surface of the image carrier so as to form the nip, the elastic layer is deformed while in the stopping state. Then, when image forming is performed using the secondary transfer roller which has been deformed, transfer defect or speed variation occurs in a corresponding image forming process and, as a result, the image defect such as color deviation or banding of the image occurs.

In addition, there is a need to move the secondary transfer roller to a predetermined position (recording medium gripping position) in order to grip the recording medium by the grip unit, but in the case where the transfer technique described in JP-A-2000-238400 (FIG. 1) is employed, there is a need to position the secondary transfer roller on the predetermined position by freely running the secondary transfer roller in a state in which the recording medium is not gripped. At this time, in a case where there is a liquid developer on the surface of the image carrier, since the liquid developer is attached to the outer peripheral surface of the secondary transfer roller running freely, the liquid developer is attached to the rear surface of the recording medium when the recording medium passes through the nip, so that he recording medium may be contaminated.

SUMMARY

An advantage of a first aspect of the invention is to provide an image forming apparatus and an image forming method which can prevent deformation of the elastic layer while the transfer roller stops and prevent degradation in the image quality of the image to be formed.

In addition, an advantage of a second aspect of the invention is to provide an image forming apparatus and an image forming method which can prevent contamination of the recording medium.

According to the first aspect of the invention, there is provided an image forming apparatus which includes: an image carrier which carries an image; a transfer roller which includes a roller base material which faces the image carrier and rotates, a concave portion which is provided on a peripheral surface of the roller member, a grip unit which is disposed on the concave portion and grips a recording medium, and an elastic layer which is disposed on a peripheral surface of the roller member, the transfer roller passing the recording medium through a nip which is formed between the image carrier and the elastic layer which comes into contact with the image carrier via the image carrier and the recording medium so as to transfer the image carried on the image carrier onto the recording medium; a roller driving unit which rotates the roller base material; and a control unit which controls the roller driving unit and causes the concave portion to face the image carrier so as to stop the transfer roller.

In addition, according to the first aspect of the invention, there is provided an image forming method which includes the steps of: rotating a roller base material while facing an image carrier which is driven while carrying an image; gripping a recording medium by a grip unit which is disposed on a concave portion while causing the concave portion provided on a peripheral surface of the roller base material to come into contact with the image carrier; transferring the image carried on the image carrier onto the recording medium by passing the recording medium through a nip while an elastic layer disposed on a peripheral surface of the roller base material faces the image carrier so as to form the nip between the image carrier and the elastic layer; and causing the concave portion to face the image carrier so as to stop the transfer roller after the image is transferred onto the recording medium.

In the invention (image forming apparatus and image forming method) as configured above, when the transfer roller stops, the concave portion of the transfer roller faces the image carrier, and the elastic layer is separated from the image carrier. For this reason, the deformation of the elastic layer can be effectively prevented while the transfer roller stops, and even though the image forming is performed thereafter, defects such as transfer defects or speed variations do not occur, so that the image on the image carrier can be effectively transferred onto the recording medium. In particular, if the opening width of the concave portion in the rotation direction of the roller base material is configured to be wider than that of the nip in the rotation direction of the roller base material, the allowance in the stop position of the transfer roller can be increased. That is, with the above-mentioned configuration, even though a stop position of the concave portion with respect to the image carrier is slightly shifted, the elastic layer does not come into contact with the image carrier, and the above-mentioned operational effect can be obtained.

In addition, it may be configured such that after the recording medium to be transported is gripped by the grip unit, the transfer roller passes the recording medium through the nip so as to transfer the image on the image carrier onto the recording medium. In this case, the second aspect can be achieved by configuring as follows. That is, when the rotation of the transfer roller starts after the recording medium starts to be transported to the transfer roller, the image on the image carrier can be transferred onto the recording medium by the transfer roller without freely rotating the transfer roller. Therefore, it is possible to prevent toner or developer constituting the image from being attached on the transfer roller, and the recording medium can be prevented from being contaminated. In particular, when the transfer roller stops, the concave portion is suitably configured for being positioned on the upstream side in the rotation direction with respect to the recording medium gripping position in which the recording medium is gripped. In this case, when the transfer roller is rotated in one rotation direction, that is, in the above-mentioned rotation direction so as to move to the recording medium gripping position and the elastic portion faces the image carrier so as to form the nip, so that the image on the image carrier can be transferred onto the recording medium, and the gripping of the recording medium and the transfer process can be performed continuously and smoothly.

In addition, when the image carrier is a transfer belt which is disposed to be parallel or substantially parallel to the roller base material so as to rotate in a forward direction with respect to the rotation direction of the roller base material, and which is wound around the belt transport roller, it may be configured as follows. That is, it may be configured such that the transfer roller includes a butting member which rotates together with the roller base material, and the butting member comes into contact with the belt transport roller while the concave portion faces a belt-typed image carrier and, on the other hand, the butting member is separated from the belt transport roller while the nip is formed. In this case, the control unit may determine a stop timing of the transfer roller on the basis of the time when the butting member starts to come into contact with the belt transport roller, and thereby the transfer roller can be stopped on a desired position with high accuracy.

BRIEF DESCRIPTION OF THE DRAWINGS

The invention will be described with reference to the accompanying drawings, wherein like numbers reference like elements.

FIGS. 4A-1 to 4B-2 are diagrams illustrating a relationship among a secondary transfer roller, an intermediate transfer belt and a driving roller.

DESCRIPTION OF EXEMPLARY EMBODIMENTS

Figure 1:
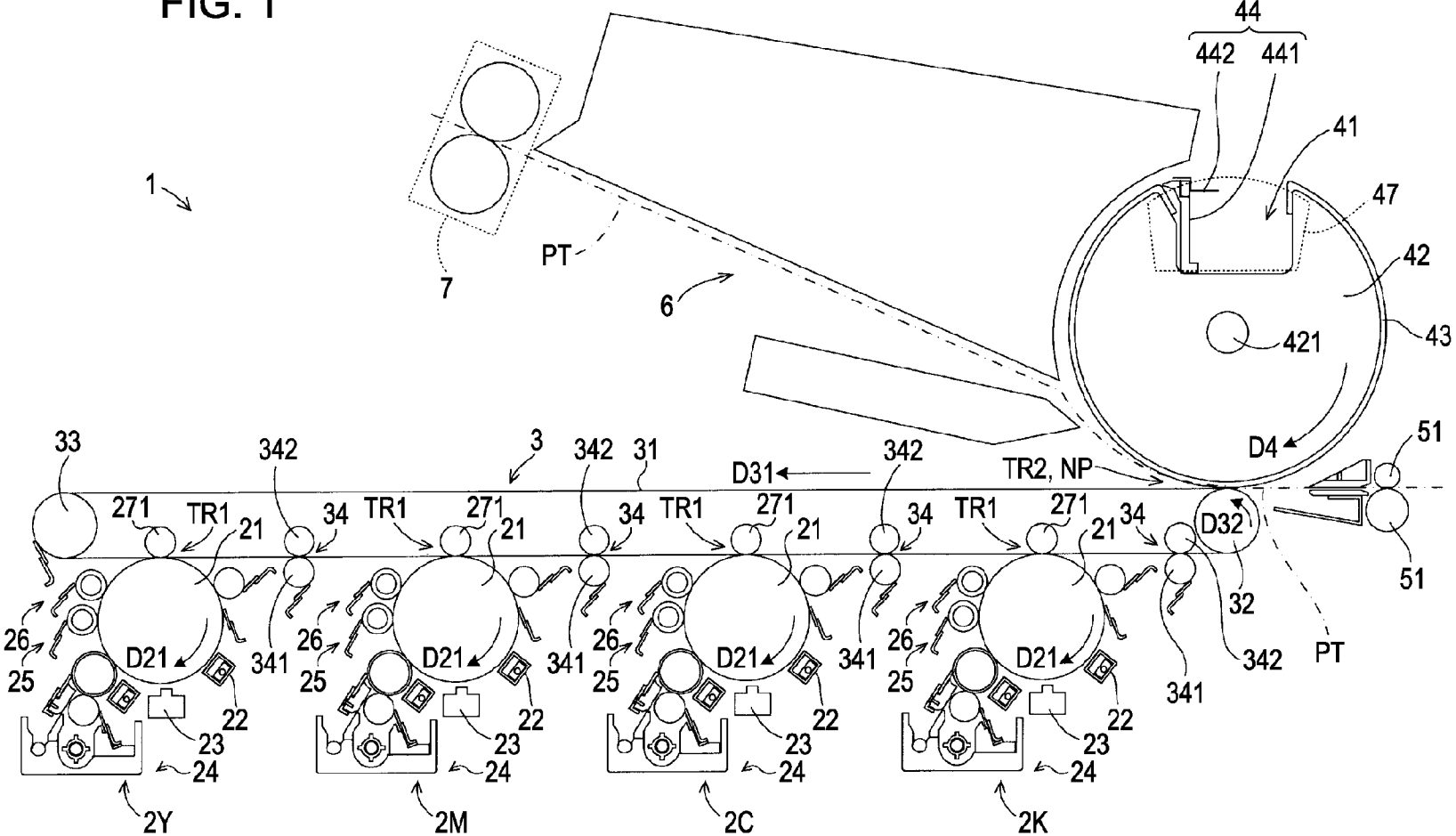
FIG. 1 is a diagram illustrating an image forming apparatus according to a first embodiment of the invention.
Figure 2:
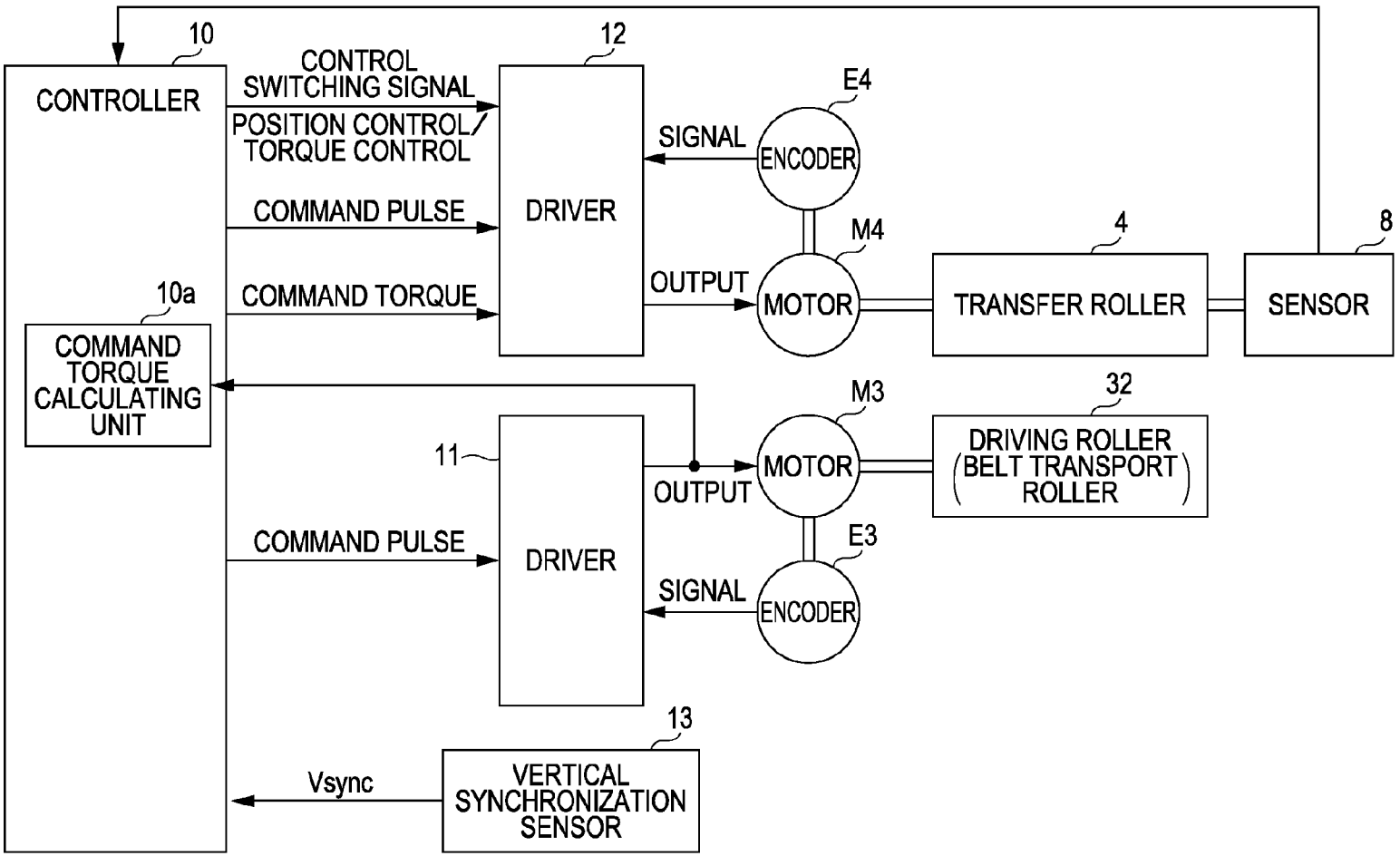
FIG. 2 is a block diagram illustrating the electric configuration of the apparatus shown in FIG. 1.

FIG. 1 is a diagram illustrating an image forming apparatus according to a first embodiment of the invention. In addition, FIG. 2 is a block diagram illustrating an electric configuration of the apparatus shown in FIG. 1. The image forming apparatus 1 is provided with four image forming stations 2Y (yellow), 2M (magenta), 2C (cyan) and 2K (black) for forming different color images different from each other. The image forming apparatus 1 is configured to be able to selectively perform a color mode in which toner of four colors of yellow (Y), magenta (M), cyan (C) and black (K) are mixed to form a color image, and in a monochrome mode in which only a black (K) toner is used to form a monochrome image. In the image forming apparatus, when an external apparatus such as a host computer gives an image forming command to a controller 10 having a CPU or a memory or the like, the controller 10 controls each part of the apparatus so as to perform a predetermined image forming operation, and forms an image corresponding to the image forming command on a sheet-shaped recording medium RM such as copy paper, transfer paper, paper and a transparent sheet for OHP. As described above, in this embodiment, the controller 10 corresponds to a "control unit" according to the invention.

In each of the image forming stations 2Y, 2M, 2C and 2K, a photosensitive drum 21 is provided to form each color of toner image on a surface thereof. Each photosensitive drum 21 is disposed such that the rotation shaft thereof is parallel or substantially parallel to the main scanning direction (vertical direction with respect to the paper of FIG. 1), and is rotatably driven at a predetermined speed in the direction of arrow D21 in FIG. 1.

In the vicinity of each photosensitive drum 21, a charger 22 which is a corona charger for charging the surface of the photosensitive drum 21 with a predetermined potential, an exposure unit 23 which forms an electrostatic latent image by exposing the surface of the photosensitive drum 21 according to an image signal, a developing unit 24 which develops the electrostatic latent image as a toner image, a first squeeze unit 25, a second squeeze unit 26, a primary transfer unit which primarily transfers the toner image onto an intermediate transfer belt 31 of the transfer unit 3, a cleaning unit which cleans the surface of the photosensitive drum 21 after transferring, and a cleaner blade are disposed along the rotation direction D21 (clockwise direction in FIG. 1) of the photosensitive drum 21 in the order described above.

The charger 22 does not come into contact with the surface of the photosensitive drum 21, and as for the charger 22, the well-known corona charger according to the related art may be used. When a scorotron charger is used as the corona charger, negative wire current flows in a charge wire of the scorotron charger and a grid charge bias of direct current (DC) is applied to a grid. The photosensitive drum 21 is charged by corona discharge of the charger 22, so that the potential of the surface of the photosensitive drum 21 is set to a uniform potential.

The exposure unit 23 exposes the surface of the photosensitive drum 21 to light beam according to an image signal given from an external apparatus so as to form an electrostatic latent image corresponding to the image signal. As for the exposure unit 23, it can be configured by one which scans light beam from a semiconductor laser using a polygon mirror, or by a line head in which light-emitting elements are disposed in a main scanning direction.

Toner are supplied from the developing unit 24 on the electrostatic latent image formed as described above, so that the electrostatic latent image is developed by the toner. In the developing unit 24 of the image forming apparatus 1, the toner are developed by using a liquid developer in which toner are dispersed in a carrier liquid in an amount of about 20%. In this embodiment, instead of a volatile liquid developer with low concentratation (1 to 2 wt %) and low viscosity which volatilizes at room temperature and has a carrier liquid as Isopar (Registered Trademark: EXXON), a liquid developer is used, in which a high-concentrated and high-viscosity solid content with an average particle diameter of 1 μm made by dispersing a colorant such as a pigment into a nonvolatile resin at room temperature is added as a dispersion agent into a liquid solvent such as an organic solvent, a silicon oil, a mineral oil or an edible oil, and which has high viscosity (about 30 to 10000 mPa·s) of which the concentration of toner solid content is about 20%.

On the downstream side of a develop position in the rotation direction D21 of the photosensitive drum 21, the first squeeze unit 25 is disposed, and a second squeeze unit 26 is disposed on the downstream side of the first squeeze unit 25. Each of these squeeze units 25 and 26 is provided with a squeeze roller. Then, each squeeze roller comes into contact with the surface of the photosensitive drum 21 so as to remove a surplus carrier liquid or fog toner. Further, in this embodiment, the surplus carrier liquid or the fog toner is removed by two squeeze units 25 and 26, but the number or the arrangement of the squeeze units is not limited. For example, one squeeze unit may be disposed.

A toner image passing through the squeeze units 25 and 26 is primarily transferred onto the intermediate transfer belt 31 by the primary transfer unit. The intermediate transfer belt 31 is suspended on a pair of belt transport rollers (belt tension roller) 32 and 33 which are separately disposed from each other so as to peripherally rotate in a predetermined direction D31 by the rotation of the belt driving motor M3. More specifically, the roller 32 on the left side in FIG. 1 among these belt transport rollers 32 and 33 comes to be a driving roller, and the belt driving motor M3 is mechanically connected to the driving roller 32. In addition, in this embodiment, a driver 11 is provided to drive the belt driving motor M3, and outputs a driving signal according to a command pulse given from the controller 10 to the belt driving motor M3 so as to be subjected to the position control. Therefore, the driving roller (belt transport roller) 32 rotates in the direction of arrow D32 in FIG. 1 at a peripheral speed corresponding to the command pulse, and the surface of the intermediate transfer belt 31 moves peripherally in the direction D31 at a predetermined speed. Further, Reference numeral E3 in the drawing denotes an encoder which is attached to the belt driving motor M3, and supplies a signal corresponding to the rotation of the belt driving motor M3 to the driver 11. The driver 11 received the signal carries out a feedback control on the belt driving motor M3 on the basis of the signal. In this embodiment, the intermediate transfer belt 31 configured as described above corresponds to the "image carrier" according to the invention.

In addition, in the intermediate transfer belt 31, a feature portion such as a notch or a protrusion is formed and, as described above, moves peripherally along a predetermined peripheral orbit as the intermediate transfer belt 31 peripherally rotates in a predetermined direction D31. In addition, the vertical synchronization sensor 13 (FIG. 2) is fixedly disposed on the peripheral orbit, and whenever the sensor detects the feature portion, the signal level of the vertical synchronization signal Vsync output from the vertical synchronization sensor 13 is changed from the L level to the H level. In the controller 10 in which the vertical synchronization signal Vsync is input, each unit is controlled on the basis of the vertical synchronization signal Vsync so as to perform the image forming process. Further, the operation sequence will be described later.

The primary transfer unit has a backup roller 271. The backup roller 271 is disposed at a primary transfer position TR1 so as to face the photosensitive drum 21 with the intermediate transfer belt 31 interposed therebetween, and transfers a toner image on the photosensitive drum 21 onto the intermediate transfer belt 31. By performing the transfer of the toner image by each color of the transfer units 27, each color of the toner images on the photosensitive drum 21 is sequentially overlapped onto the intermediate transfer belt 31 so as to form a full color of the toner image.

In this embodiment, in order to remove surplus carrier liquid from the toner image transferred on the intermediate transfer belt 31, a belt squeeze unit 34 is disposed on the downstream side of the primary transfer position TR1 for each color. In the belt squeeze unit 34, an intermediate transfer squeeze roller 341 is disposed on a carrier surface side of the toner image of the intermediate transfer belt 31, and a backup roller 342 is disposed to face the intermediate transfer squeeze roller 341 with the intermediate transfer belt 31 interposed therebetween. By the intermediate transfer squeeze roller 341, the surplus carrier liquid is removed from the toner image on the intermediate transfer belt 31.

The toner image transferred on the intermediate transfer belt 31 as described above is transported to a secondary transfer position TR2 as shown in FIG. 1. At the secondary transfer position TR2, the secondary transfer roller 4 is disposed to face the driving roller 32 of the transfer unit 3 with the intermediate transfer belt 31 interposed therebetween, and the intermediate transfer belt 31 is wound around the driving roller 32. At the secondary transfer position TR2, a monochrome color or plural color toner image formed on the intermediate transfer belt 31 is transferred onto the recording medium RM which is transported along a transport path PT from a pair of gate rollers 51 and 51. Further, in this embodiment, since the toner image is formed in a wet developing method of forming a toner image using a liquid developer, the secondary transfer roller 4 having a grip unit is used which is described later.

The recording medium RM on which the toner image is secondarily transferred is sent to a transport mechanism 6 along the transport path PT from the secondary transfer roller 4. In addition, on the downstream side of the transport path PT, that is, an opposite side (left side of FIG. 1) of the secondary transfer roller 4 with respect to the transport mechanism 6, a fixing unit 7 is disposed to apply heat or pressure on a monochrome color or plural color toner image which is transferred on the recording medium RM so as to fix the toner image onto the recording medium RM.

Figure 3A:
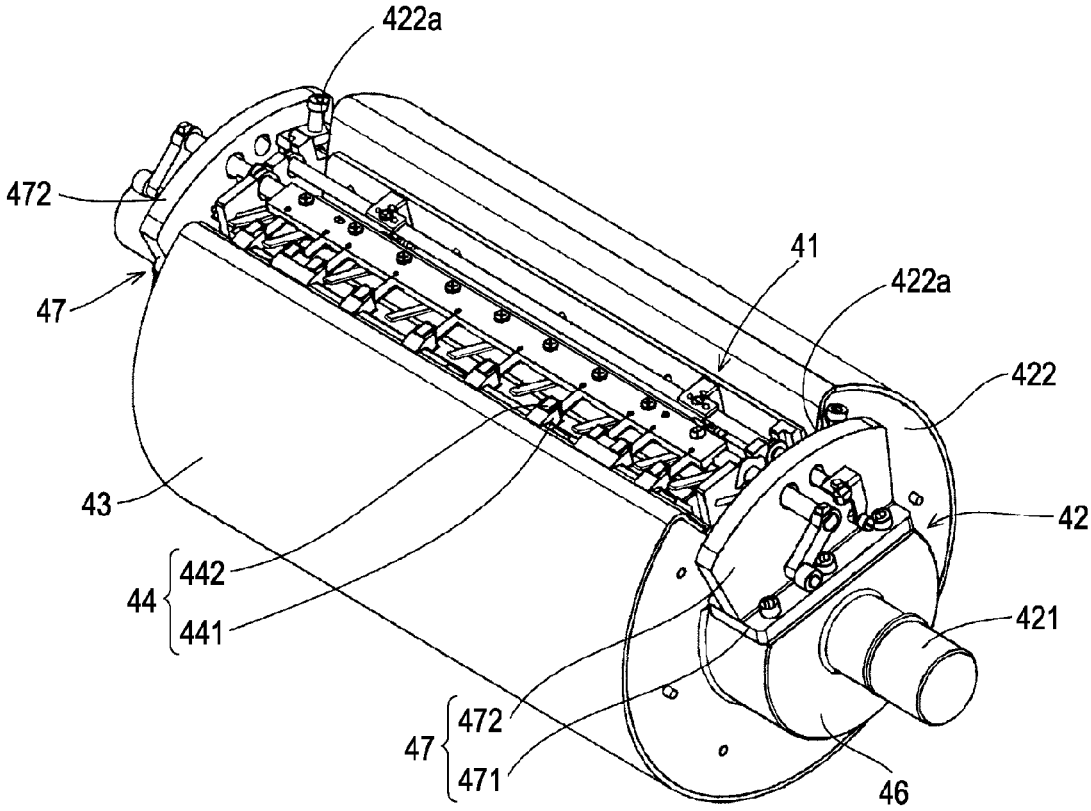
FIGS. 3A and 3B are diagrams illustrating a secondary transfer roller which is used by the image forming apparatus shown in FIG. 1.
Figure 3B:
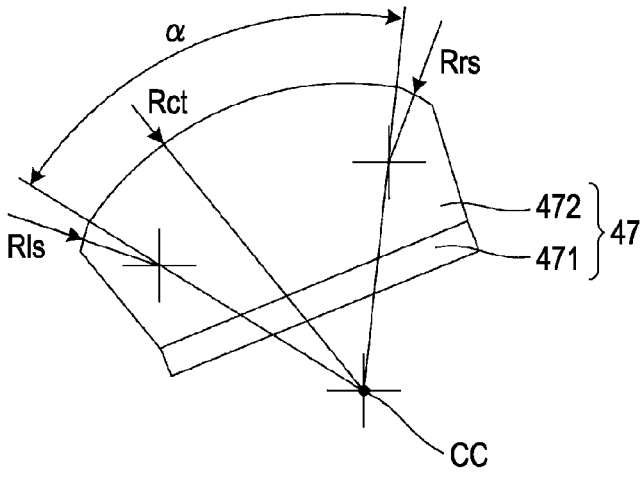

FIGS. 3A and 3B are diagrams illustrating the secondary transfer roller which is used in the image forming apparatus shown in FIG. 1. FIG. 3A is a perspective view illustrating the entire configuration of the secondary transfer roller, and FIG. 3B is a side view illustrating the shape of a contact member. In addition, FIGS. 4A-1, 4A-2, 4B-1 and 4B-2 are diagrams illustrating a relationship among the secondary transfer roller, the intermediate transfer belt and the driving roller. FIG. 4A-1 is a side view illustrating a concave portion facing the driving roller, FIG. 4A-2 is a cross-sectional view taken along the line IVAII-IVAII in FIG. 4A-1, FIG. 4B-1 is a side view illustrating a formed nip, and FIG. 4B-2 is a cross-sectional view taken along the line IVBII-IVBII of FIG. 4B-1. As shown in these drawings, the secondary transfer roller 4 includes a roller base material 42 in which the concave portion 41 is provided on the peripheral surface. As shown in FIGS. 4A-1 to 4B-2, in the roller base material 42, a rotation shaft 421 is disposed to be parallel or substantially parallel to a rotation shaft A32 (see FIGS. 4A-1 to 4B-2) of the driving roller (belt transport roller) 32, and side plates 422 and 422 are respectively attached to both ends of the rotation shaft 421. More specifically, all of these side plates 422 and 422 are in a shape in which a notched portion 422*a* with respect to a disk-shaped metal plate. The notched portion 422*a* is in a substantially-rectangular shape in a side view shown in FIGS. 4A-1 and 4B-1. As shown in FIGS. 3A and 3B, the notched portions 422*a* and 422*a* is separated by a distance slightly longer than the width of intermediate transfer belt 31 while facing each other so as to be attached to the rotation shaft 421. In addition, a metal plate 423 is disposed over the peripherals of both side plates 422 and 422, and the peripheral portion of the metal plate 423 is bonded to the inner surface of both side plates 422 and 422. As described above, the secondary roller is in a drum shape as a whole, and in a part of the outer peripheral surface, a roller base material 42 is formed which includes the concave portion 41 extending parallel or substantially parallel to the rotation shaft 421.

In addition, an elastic layer 43 such as rubber or resin is formed on the outer peripheral surface of the roller base material 42, that is, the surface region excepting the region corresponding to the inside of the concave portion 41 in the metal plate surface. The elastic layer 43 faces the intermediate transfer belt 31 which is wound around the driving roller 32 so as to form a nip NP as described later.

In addition, a grip unit 44 is disposed to grip the recording medium RM inside the concave portion 41. The grip unit 44 includes a gripper support member 441 which is erected on the outer peripheral surface of the roller base material 42 from the inner bottom of the concave portion 41 and a gripper member 442 which is separably supported with respect to the tip end of the gripper support member 441. In addition, the gripper member 442 is connected to a gripper driving unit (not shown). Then, while receiving a command to stop gripping from the controller 10, the gripper driving unit operates to separate the tip end of the gripper member 442 from the tip end of the gripper support member 441 so as to perform grip preparation or grip release of the recording medium RM. Further, the configuration of the grip unit 44 is not limited to this embodiment, but the gripping mechanism known from the related art, for example, JP-A-2000-238400 (FIG. 1) and the like, may be employed.

In both ends of the rotation shaft 421, support members 46 and 46 are attached on the outer surface of each side plate 422 so as to be able to integrally rotate with the roller base material 42. In addition, in each of the support members 46 and 46, a plane region 461 is formed to correspond to the concave portion 41. Then, a butting member 47 on the side of the transfer roller is attached to each of the plane regions 461 and 461. In the butting member 47, a base portion 471 is attached to the support member 46, and a butting portion 472 is extended from the base portion 471 in a normal direction of the plane region 461. The tip end of the butting portion 472 is extended up to the vicinity of the end of the opening of the concave portion 41. That is, as shown in FIG. 3A, when the roller base material 42 is viewed from the end of the rotation shaft 421, the butting member 47 is disposed to close the concave portion 41.

As shown in FIG. 3B, the tip end of the butting portion 472 is bent such that a curvature Rct of the center thereof is larger than curvatures Rrs and Rls of both ends. For example, in this embodiment, a roller external diameter of the roller base material 42 including the elastic layer 43 is set to about 191 mm, the curvature Rct thereof is set to 88.2 mm, the curvatures Rrs and Rls of both ends are set to 22.4 mm together. Further, the center CC of curvature in the center of butting portion 472 is disposed on the rotation shaft of the roller base material 42, that is, the center shaft of the rotation shaft 421. In addition, an angle range $\alpha$ of the center is set to 63° in correspondence with an open range of the concave portion 41. For this reason, when the secondary transfer roller 4 is rotated as described later, the concave portion 41 faces the intermediate transfer belt 31 wound around the driving roller 32 over the angle range $\alpha$. In addition, an opening length (opening width) W41 of the concave portion 41 along the rotation direction D4 of the roller base material 42 is 191×π×(63/360)≅105 mm. On the other hand, as described in the followings, the elastic layer 43 faces the intermediate transfer belt 31 in the other angle range so as to form the nip NP, the length of the elastic layer 43 along the rotation direction D4 of the roller base material 42 is set to 191×π×{(360−63)/360}≅495 mm. Further, in this embodiment, the length (nip width) Wnp of the nip NP along the rotation direction D4 of the roller base material 42 is about 11 mm, which is in relationship of (Opening Width W41 of Concave Portion 41)>(Nip Width Wnp of Nip NP).

In the secondary transfer roller 4 as configured above, the rotation shaft 421 is disposed to be parallel or substantially parallel to the rotation shaft A32 of the driving roller 32, and urged toward the driving roller 32 by an urging unit (not shown). For this reason, in the angle range (297° angle range) other than the angle range α, as shown in FIGS. 4B-1 and 4B-2, the elastic layer 43 is pressed on the intermediate transfer belt 31 wound around the driving roller 32 so as to form the nip NP. In addition, in this embodiment, an annular-shaped butting member 322 is attached to both ends of the rotation shaft 321 of the driving roller 32, and the external diameter is set to be larger than the value of {(Thickness of Intermediate transfer belt 31)×2+(External diameter of Driving roller 32)}. For this reason, in the angle range α, as shown in FIGS. 4A-1 and 4A-2, the center of the butting portion 472 on the transfer roller side comes into contact with the butting member 322 on the driving roller side, and the roller base material 42 and the elastic layer 43 become in a state of being separated from the intermediate transfer belt 31. In this embodiment as described above, the butting portion 472 on the transfer roller side corresponds to the "butting member" according to the invention, and comes into contact with the driving roller 32 via the butting member 322 on the driving roller, but the butting portion 472 on the transfer roller side may be configured to directly come into contact with the driving roller 32.

The transfer roller driving motor M4 is mechanically connected to the rotation shaft 421 of the secondary transfer roller 4. In addition, in this embodiment, a driver 12 is provided to drive the transfer roller driving motor M4. The driver 12 drives the motor M4 according to the command given from the controller 10, so that the secondary transfer roller 4 is rotatably driven in the clockwise direction in the paper of FIG. 1 so as to rotate in a width direction D4 with respect to the driving roller 32. As described above, in this embodiment, the secondary transfer roller 4 corresponds to the "transfer roller" according to the invention, and the driver 12 and the transfer roller driving motor M4 function as the "roller driving unit" according to the invention.

In this embodiment, an AC servo motor is used as the motor M4, and the AC servo motor is configured to be subjected to the position control or the torque control by the driver 12. That is, the driver 12 includes a position control circuit and a torque control circuit, and can selectively perform the position control and the torque control. The controller 10 can input a command pulse relating to position information, a command torque relating to torque information and a control switching signal to the driver 12. Then, the controller 10 inputs a command pulse to the driver 12 so as to switch the driving control mode of the driver 12 to perform the position control by the control switching signal, so that the driver 12 outputs a driving signal according to the command pulse to the transfer roller driving motor M4 to perform the position control so as to be able to position the secondary transfer roller 4 with accuracy. On the other hand, the controller 10 inputs a command torque to the driver 12 so as to switch the driving control mode of the driver 12 to perform the torque control by the control switching signal, so that the driver 12 outputs a driving signal according to the command torque to the transfer roller driving motor M4 to perform the torque control so as to be able to rotatably drive the secondary transfer roller 4 with torque corresponding to the command torque. In this embodiment, in order to control the change in load applied on the intermediate transfer belt 31 so as to stabilize the peripheral speed of the intermediate transfer belt 31, the command torque calculating unit 10*a* is provided at the controller 10, and the command torque determined by the command torque calculating unit 10*a* is output from the controller 10 so as to be input to the driver 12. The details of the above operation will be described later. Further, Symbol E4 in the drawing is an encoder which is attached to the transfer roller driving motor M4, and a signal corresponding to the rotation of the transfer roller driving motor M4 is given to the driver 12. Then, the driver 12 received the signal carries out a feedback control on the motor M4 on the basis of the signal.

Next, before describing the entire operation of the image forming apparatus as configured above, the operation of the secondary transfer roller 4 will be described with reference to FIG. 5.

Figure 5A:
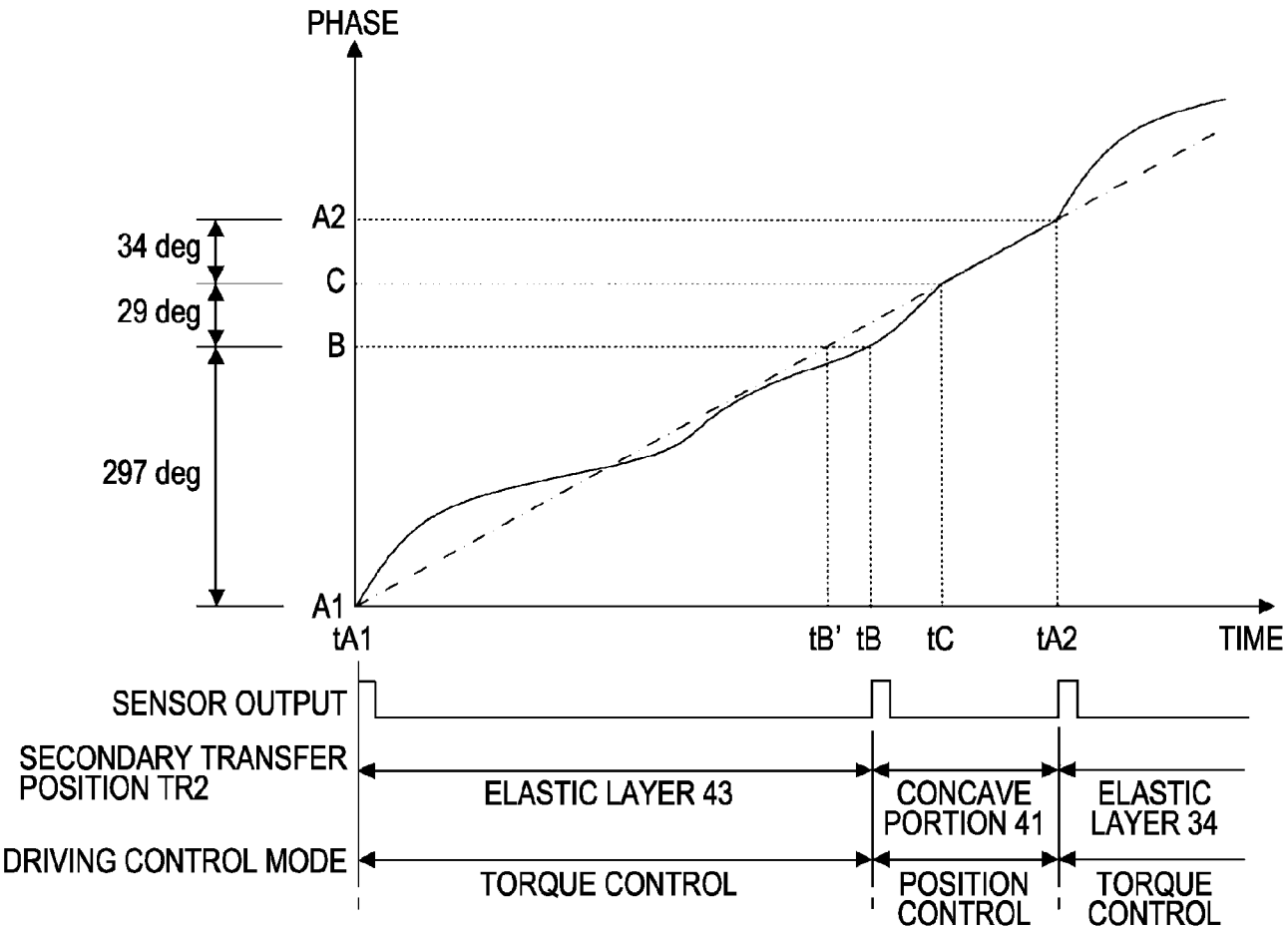
FIGS. 5A to 5C are diagrams illustrating an operation of a secondary transfer roller.
Figure 5B:
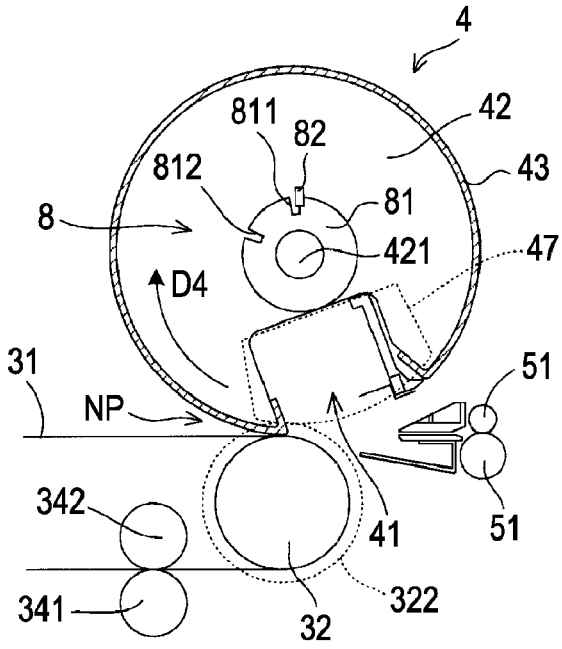
Figure 5C:
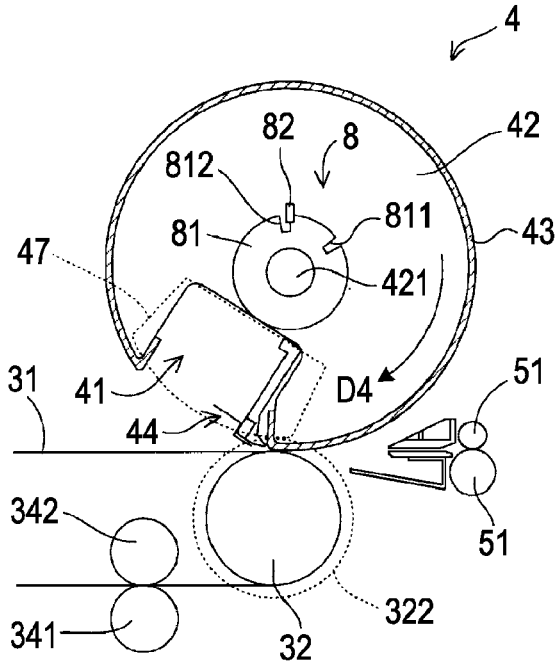

FIGS. 5A to 5C are diagrams illustrating the operation of the secondary transfer roller. FIG. 5A is a graph illustrating a relationship between the operation and the phase of the secondary transfer roller 4. FIG. 5B is a diagram schematically illustrating a positional relationship between the concave portion 41 of the secondary transfer roller 4 and the intermediate transfer belt 31 at the phase B in FIG. 5A. FIG. 5C is a diagram schematically illustrating a positional relationship between the concave portion 41 of the secondary transfer roller 4 and the intermediate transfer belt 31 at the phases Al and A2 in FIG. 5A. Symbol 8 in the drawing is a phase detecting sensor which is connected to one end of the rotation shaft 421 of the secondary transfer roller 4. In the sensor 8, a disk-shaped slit plate 81 is connected to the rotation shaft 421 so as to rotate with the rotation shaft 421. In addition, in the slit plate 81, slits 811 and 812 are formed in two places. Among two slits, the slit 811 is used to detect a nip release position, that is, a position at which the elastic layer 43 is separated from the intermediate transfer belt 31, and the slit 812 is used to detect a nip start position, that is, a position at which the elastic layer 43 starts to come into contact with the intermediate transfer belt 31. In addition, in the phase detecting sensor 8, a sensor element 82 is fixedly disposed in order to detect these slits 811 and 812. Whenever the slits 811 and 812 are positioned in the detection range of the sensor element 82, a signal level output from the sensor element 82 to the controller 10 is changed from the L level to the H level, so that the nip release position and the nip start position can be detected. Further, in FIG. 5, the phases A1 and A2 of the secondary transfer roller 4 at the detection timings tA1 and tA2 at which the nip start position is detected by the sensor 8 is called "phase A", and the phase of the secondary transfer roller 4 at the detection timing tB at which the nip release position is detected by the sensor 8 is called "phase B". Further, a chain line in FIG. 5A is a phase curve when the secondary transfer roller 4 is rotated at a constant peripheral speed.

When the phase A (nip start position: FIG. 5C) is detected at timing tA1 by the sensor 8, the controller 10 issues the control switching signal so as to prompt the driver 12 to switch the driving control mode to the torque control and gives the command torque to the driver 12. Further, in this embodiment, the command torque is determined on the basis of the calculated result by the command torque calculating unit 10*a* of the controller 10. That is, the driver 11 outputs a signal to the belt driving motor M3 in order to rotate the driving roller 32, and at the same time the output signal is given to the command torque calculating unit 10*a* as shown in FIG. 2. The signal reflects the operation of the belt driving motor M3 and the driving state of the intermediate transfer belt 31, and a load state in which the intermediate transfer belt 31 is placed is obtained by analyzing the signal. However, by monitoring the signal, the change in the load applied on the intermediate transfer belt 31 can be detected. Therefore, in this embodiment, the signal given to the belt driving motor M3 from the driver 11 is output also to the command torque calculating unit 10*a*, and the command torque calculating unit 10*a* calculates the command torque corresponding to the load state applied on the intermediate transfer belt 31. As a result, the command torque is changed to be set according to the change in the load applied on the intermediate transfer belt 31, and the command torque is given to the driver 12 in order to always suppress the change in the load applied on the intermediate transfer belt 31.

The driver 12 received these signals outputs a driving signal according to the command torque to the transfer roller driving motor M4 so as to control the torque. Thereafter, when the secondary transfer roller 4 rotates in the rotation direction D4 so that the concave portion 41 is close to the surface of the intermediate transfer belt 31 and the phase B (nip release position: FIG. 5B) is detected by the sensor 8, the controller 10 issues the control switching signal so as to prompt the driver 12 to switch the driving control mode from the torque control to the position control and gives the command pulse to the driver 12 (timing tB). As described above, in this embodiment, the elastic layer 43 comes into contact with the intermediate transfer belt 31 at the nip start position so as to form the nip NP. Since the nip forming state continues until the secondary transfer roller 4 reaches the nip release position, during this period of time (timing tA1 to tB) the torque control is carried out on the secondary transfer roller 4 while rotating in a state where the elastic layer 43 comes into contact with the intermediate transfer belt 31. Therefore, while the secondary transfer roller 4 is coming into contact with the intermediate transfer belt 31, the load from the secondary transfer roller 4 to the intermediate transfer belt 31 is not largely changed, but the surface of the intermediate transfer belt 31 is stabilized, so that the secondary transfer roller 4 can be rotated at a constant peripheral speed. In addition, the recording medium RM is passed through the nip NP, so that a toner image on the intermediate transfer belt 31 is secondarily transferred onto the recording medium RM. Further, in this embodiment, in order to prevent the recording medium RM from sticking to the surface of the intermediate transfer belt 31, the recording medium RM which is transported from the gate rollers 51 and 51 is gripped at a proper timing tC (a timing at which the secondary transfer roller 4 rotates by 29° from the nip release position) by the grip unit 44 before the recording medium RM is sent into the nip NP as described above. More specifically, the secondary transfer roller 4 is controlled in its position as described in the following.

In this embodiment, a rotation speed ω0 (deg/sec) of the secondary transfer roller 4 (roller base material 42) at a timing tB, in which the phase B is detected by the sensor 8, that is, the nip release position is detected, is changed by the equation, $\omega 0=29/(tC-tB)$. Therefore, the grip unit 44 at the timing tC is located on a position (recording medium gripping position (see FIG. 7C)) in which the recording medium RM transported from the gate rollers 51 and 51 can be gripped. Further, before the secondary transfer roller 4 reaches the recording medium gripping position, the controller 10 operates the gripper driving unit at a proper timing so as to separate the tip end of the gripper member 442 from the tip end of the gripper support member 441, and the gripping preparation of the recording medium RM is completed. Therefore, the recording medium RM can be securely gripped at the recording medium gripping position.

In addition, when reaching the timing tC, the rotation speed ω1 (deg/sec) of the secondary transfer roller 4 is changed by the equation, $\omega 1=34/(tA2-tC)$.

As described above, while the concave portion 41 is facing the intermediate transfer belt 31, at the same time or a slightly delayed time when the secondary transfer roller 4 reaches the recording medium gripping position, the controller 10 operates the gripper driving unit to move the tip end of the gripper member 442 to the tip end of the gripper support member 441 so as to grip the recording medium RM. Therefore, the operation of gripping the recording medium RM, that is, "Paper biting operation" is performed.

When the secondary transfer roller 4 rotates from the phase C (recording medium gripping position) by 34°, the phase A2 is detected by the sensor 8 at the timing tA2. Then, as described above, the driving control mode of the secondary transfer roller 4 by the driver 12 is switched from the position control to the torque control, and the secondary transfer operation is performed under the torque control.

Figure 6:
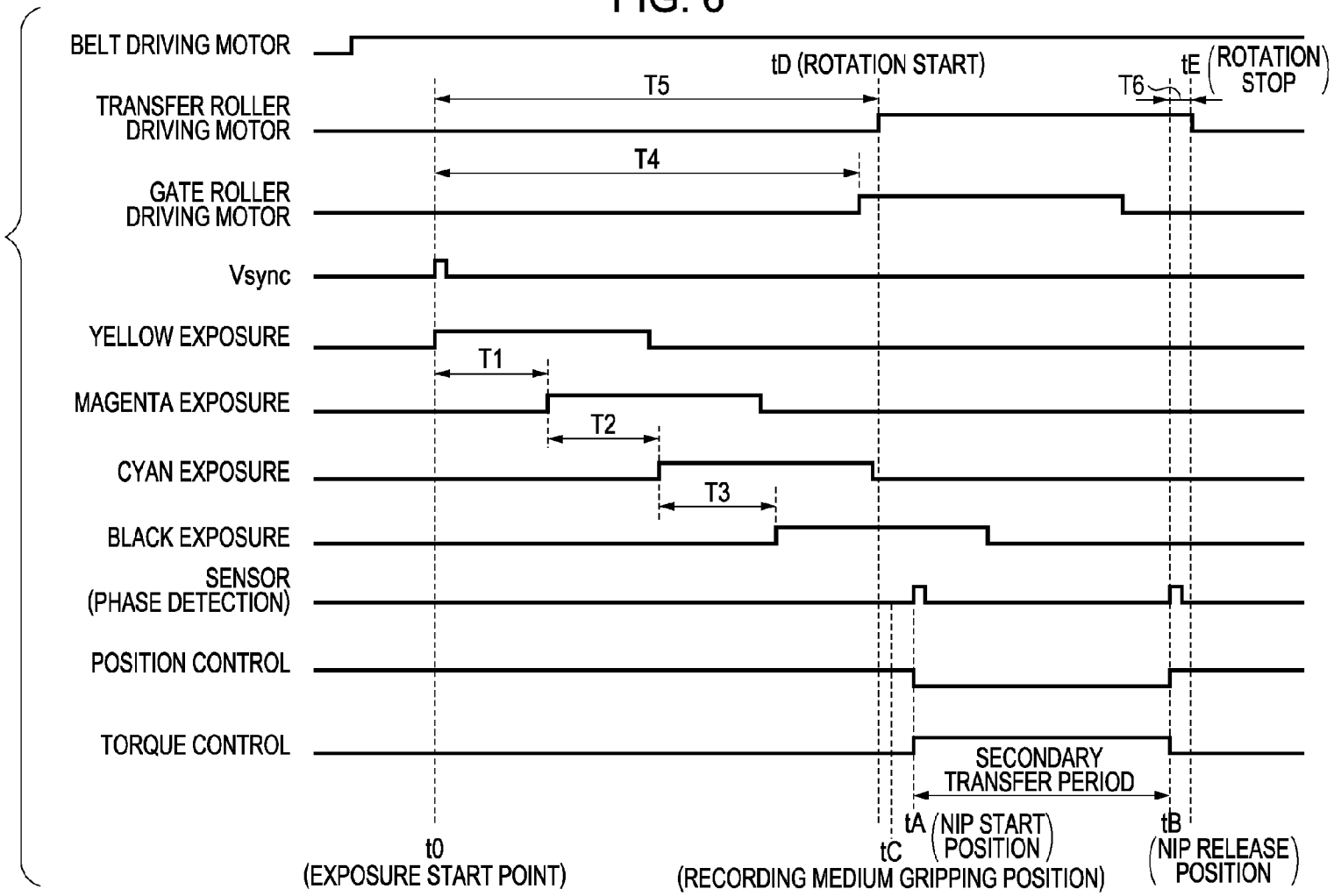
FIG. 6 is a timing chart illustrating an operational example of the image forming apparatus shown in FIG. 1.
Figure 7A:
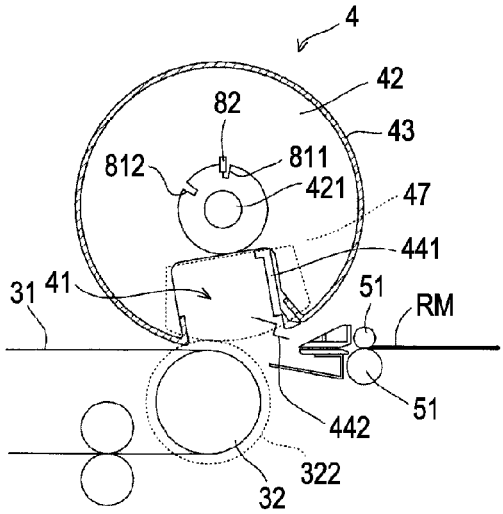
FIGS. 7A to 7D are diagrams schematically illustrating of an operation of the image forming apparatus shown in FIG. 1.
Figure 7B:
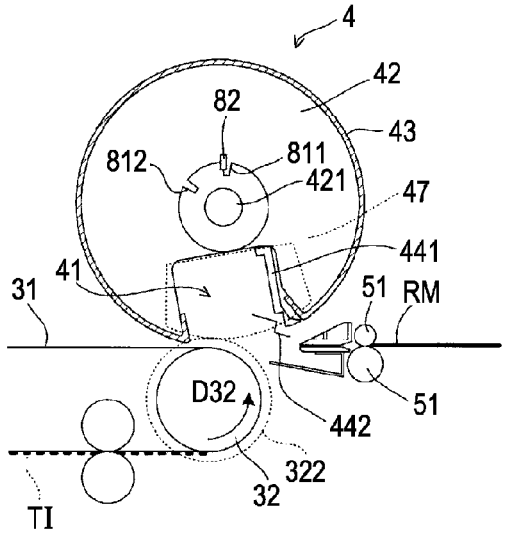

Next, the operation of the image forming apparatus 1 as configured above will be described with reference to FIGS. 6 to 8. FIG. 6 is a timing chart illustrating the operational example of the image forming apparatus shown in FIG. 1. In addition, FIGS. 7 and 8 are diagrams schematically illustrating the operation of the image forming apparatus shown in FIG. 1. In the image forming apparatus 1, as shown in FIG. 7A, the secondary transfer roller 4 stops in a state in which the concave portion 41 faces the intermediate transfer belt 31 wound around the driving roller 32, and waits to receive the image forming command from an external apparatus such as a host computer. Then, for example, when an image forming command on forming a color image is given to the controller 10, the controller 10 controls each unit in the apparatus according to programs which is stored in a memory (not shown). First, the belt driving motor M3 operates and drives the intermediate transfer belt 31. Then, when the feature portion of the intermediate transfer belt 31 passes through the vertical synchronization sensor 13 so that the vertical synchronization signal Vsync is changed from the L level to the H level at the timing t0, the controller 10 sets the timing t0 as an exposure start point, forms the toner image by each of the image forming stations 2Y, 2M, 2C and 2K, and primarily transfers the toner image onto the surface of the intermediate transfer belt 31. That is, as shown in FIG. 6, the exposure unit 23 of the image forming station 2Y starts a latent image formation on the basis of various signals from the controller 10 at the same time with the timing t0, and the toner image is formed with the yellow toner. In addition, when a time T1 lapses from the starting of the yellow exposure, the magenta exposure starts, and when a time T2 lapses from the magenta exposure, the cyan exposure starts, and when a time T3 lapses from the starting of the cyan exposure, the black exposure starts. Therefore, each color of toner image is formed and overlapped on the intermediate transfer belt 31, so that a full color of toner image TI is formed on the surface of the intermediate transfer belt 31.

In addition, when the time T4 lapses from the timing t0, the controller 10 inputs a command pulse to a driver (not shown) which controls the gate roller driving motor connected to the gate rollers 51 and 51 so as to operate the gate roller driving motor. Therefore, the transportation of the recording medium RM onto the secondary transfer position TR2 starts (FIG.

Figure 7C:
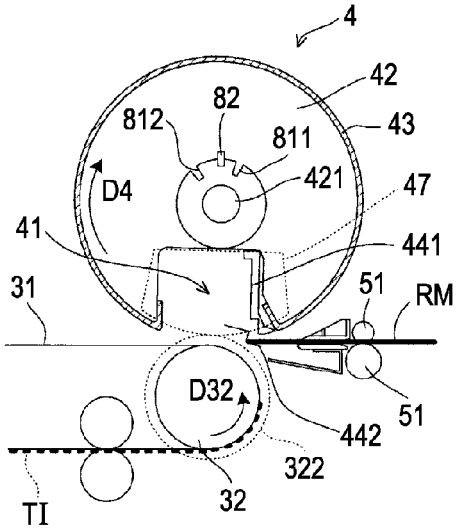

7B). In addition, when the time T5 (>T4) lapses from the timing t0, the controller 10 sets the driving control mode of the driver 12 to the position control by a control switching signal, and gives a command pulse to the driver 12 (timing tD). Therefore, the secondary transfer roller 4 is delayed by a predetermined time (=T5−T4) from the gate rollers 51 and 51 so as to start to be rotated in the rotation direction D4. Then, the secondary transfer roller 4 moves to the recording medium gripping position at the timing tC and, at the same time, the tip end of the recording medium RM transported from the gate rollers 51 and 51 enters between the gripper member 442 and the gripper support member 441, and the paper biting operation starts (FIG. 7C).

Figure 7D:
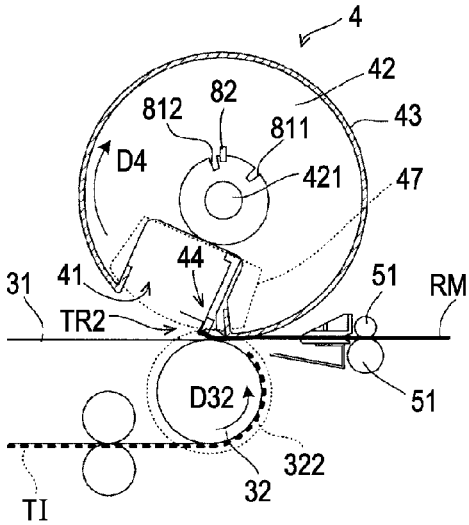

The controller 10 gives the gripping command to a gripper driving unit (not shown) at the same or slightly delayed time as the timing tC. The gripper driving unit receives the gripping command and operates, so that the tip end of the gripper member 442 is moved to the tip end of the gripper support member 441. Therefore, the tip end of the recording medium RM is gripped, and the "paper biting operation" is completed (FIG. 7D). Further, the "paper biting operation" is carried out before the secondary transfer roller 4 is in the phase A (nip start position), and at the point of time when the "paper biting operation" is completed, the toner image TI is located on the upstream side of the secondary transfer position TR2 in the moving direction D31 of the surface of the intermediate transfer belt 31 as shown in FIG. 7D.

Figure 8A:
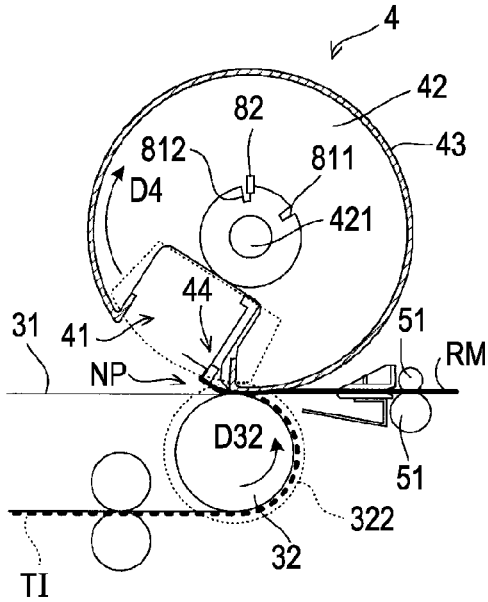
FIGS. 8A and 8C are diagrams schematically illustrating an operation of the image forming apparatus shown in FIG. 1.

While the tip end thereof being gripped by the grip unit 44, the recording medium RM is transported in the rotation direction D4 together with the secondary transfer roller 4. When the secondary transfer roller 4 reaches the phase A (nip start position), the elastic layer 43 of the secondary transfer roller 4 faces the surface of the intermediate transfer belt 31 from the timing to so as to form the nip NP, and transports the recording medium RM interposed therebetween. Therefore, the secondary transfer starts onto the lower surface (surface) of the recording medium RM of the toner image TI which is formed on the intermediate transfer belt 31 (FIG. 8A). In addition, at the timing tA, the controller 10 switches the driving control mode of the driver 12 to the torque control by the control switching signal, and gives a command torque to the driver 12 so as to perform the torque control on the secondary transfer roller 4.

Figure 8B:
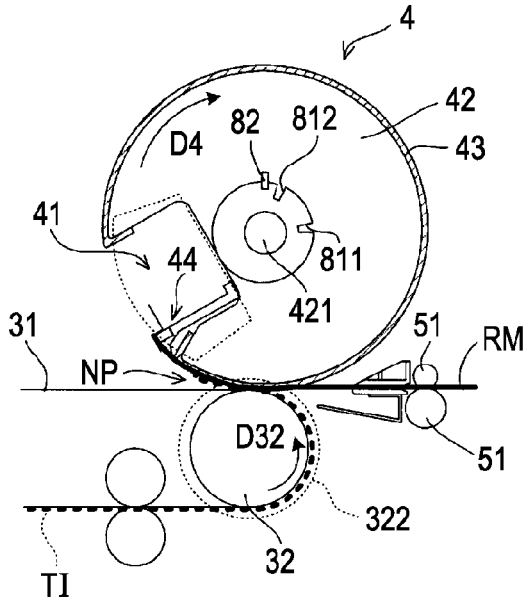
Figure 8C:
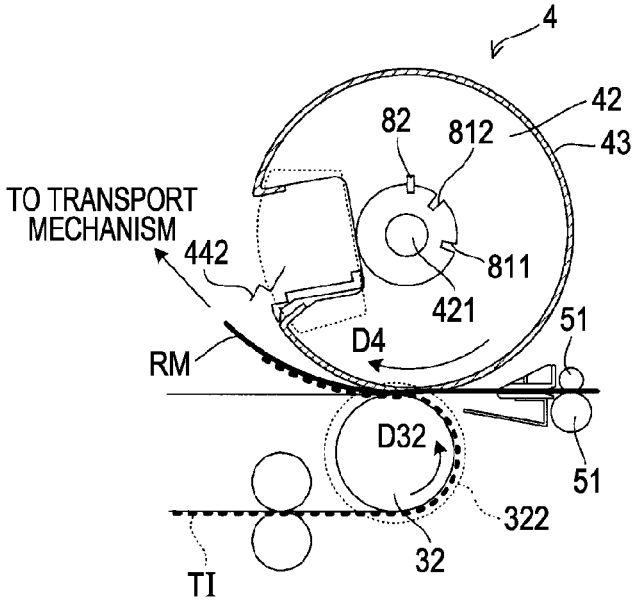

While being subjected to the torque control, the secondary transfer roller 4 rotates in the rotation direction D4, and also the recording medium RM passes through the nip NP in a state where the tip end thereof is held on the grip unit 44, so that the secondary transfer of the toner image TI progresses (FIG. 8B). Then, when the grip unit 44 moves up to the proximity position of the upstream end (which is the end on the right end side of FIG. 1) of the transport mechanism 6, the tip end of the recording medium held on the grip unit 44 is sufficiently separated from the intermediate transfer belt 31 so as to be transported up to a transport inlet of the transport mechanism 6. Then, in this embodiment, as shown in FIG. 8C, the controller 10 gives the gripper driving unit the release command at the timing when the grip unit 44 moves to the vicinity of the upstream end of the transport mechanism 6, separates the tip end of the gripper member 442 from the tip end of the gripper support member 441 so as to release the gripping of the recording medium RM. Therefore, the tip end of the recording medium RM is fed into the transport inlet of the transport mechanism 6, and transported to the fixing unit 7 via the transport mechanism 6. Then, the fixing of the toner image TI onto the recording medium RM is carried out by the fixing unit 7. Further, after the releasing, while the tip end of the recording medium RM is transported to the fixing unit 7 along the transport path PT by the transport mechanism 6, the back end of the recording medium RM is nipped and transported in the nip NP by the elastic layer 43 of the secondary transfer roller 4 and the intermediate transfer belt 31, and the secondary transfer process is performed.

When the transportation of the recording medium RM from the gate rollers 51 and 51 is completed, the controller 10 stops the rotation of the gate roller driving motor. In addition, when the secondary transfer process is completed and the secondary transfer roller 4 is in the phase B (nip release position) at the timing tB, the controller 10 stops the rotation of the transfer roller driving motor M4 at the timing tE which is a timing lapsing by a predetermined time T6 from the corresponding timing tB. The butting portion 472 on the transfer roller which corresponds to the "butting member" of the invention as described above begins to come into contact with the butting member 322 on the driving roller of the driving roller 32, so that the stop timing tE of the secondary transfer roller 4 is determined on the basis of the timing tB in which the secondary transfer roller 4 is in the phase B. Therefore, the secondary transfer roller 4 can be always stopped at a predetermined position (between the phase B and the phase C). Then, while stopping the secondary transfer roller 4 in a state of waiting for an image forming command as shown in FIG. 7A, the controller 10 waits the next image forming command.

As described above, according to the first embodiment, as shown in FIG. 7A, while the image forming is not being performed, the concave portion 41 of the secondary transfer roller 4 faces the intermediate transfer belt 31 which is wound around the driving roller 32, and the elastic layer 43 is separated from the intermediate transfer belt 31. For this reason, it is possible to prevent that the elastic layer 43 is deformed while the secondary transfer roller 4 is stopped. Even when the image forming is performed according to the next image forming command, there is no defect such as transfer defect or speed variation. In addition, a good toner image TI can be transferred onto the recording medium RM.

In addition, in this embodiment, the opening width W41 of the concave portion 41 in the rotation direction D4 of the transfer roller 4 is wider than the nip width of the nip NP. For this reason, when the secondary transfer roller 4 stops rotating at the timing tE, even though a stop position of the concave portion 41 with respect to the intermediate transfer belt 31 is slightly shifted, the elastic layer 43 does not come into contact with the intermediate transfer belt 31, and the above-mentioned operational advantage can be obtained. In other words, the allowance in the stop position of the secondary transfer roller 4 can be enhanced.

In addition, in this embodiment, the secondary transfer roller 4 stops in a state of stopping between the phase B (nip release position) and the phase C (recording medium gripping position), the secondary transfer roller 4 begins to rotate immediately before the toner image TI and the recording medium RM are transported to the secondary transfer position TR2 so as to the secondary transfer is performed. For this reason, the secondary transfer roller 4 directly performs the secondary transfer via the phase C (recording medium gripping position) and the phase A (nip start position), that is, in this embodiment, the secondary transfer roller does not run freely but performs the secondary transfer process. Therefore, the toner or the liquid developer on the intermediate transfer belt 31 can be prevented from being attached to the elastic layer 43, and the rear surface (toner image) of the recording medium RM in the secondary transfer process can be prevented from being contaminated.

In addition, in the first embodiment, operational advantages are obtained as follows. In other words, while the concave portion 41 is facing the intermediate transfer belt 31, that is, until the secondary transfer roller 4 reaches the phase A (nip start position) from the phase B (nit release position), the driving control mode of the driver 12 is switched to the position control so as to make the transfer roller driving motor M4 to be in the position control. Therefore, the secondary transfer roller 4 can be accurately positioned on the recording medium gripping position, and the recording medium RM can be accurately gripped by the grip unit 44. On the other hand, while the elastic layer 43 faces the intermediate transfer belt 31 to form the nip NP and thus the secondary transfer process is being carried out, that is, until the secondary transfer roller 4 reaches the phase B (nip release position) from the phase A (nip start position), the transfer roller driving motor M4 is subjected to the torque control. Therefore, the load applied on the intermediate transfer belt 31 can be suppressed not to be changed, so that the intermediate transfer belt 31 can be stably driven. As a result, the degradation in image quality caused by the speed change of the intermediate transfer belt 31 can be effectively prevented.

In addition, the torque control is carried out while the nip NP is being formed. However, there is a case where the recording medium RM passes through the nip NP and a case where the recording medium RM does not pass through, the loads applied on the intermediate transfer belt 31 in both cases are different from each other. Therefore, when the controller 10 changes the command torque in both cases, the change in the load applied on the intermediate transfer belt 31 can be further suppressed, which is suitable.

In addition, even when the recording medium RM passes through the nip NP, if a thickness, a material, a size and a shape of the recording medium RM are different, the load on the intermediate transfer belt 31 is differentiated. Therefore, when the controller 10 changes the command torque according to the kind of recording medium RM, the change in the load applied on the intermediate transfer belt 31 can be further suppressed, which is suitable.

Furthermore, in the above-mentioned embodiment, the controller 10 is provided with a command torque calculating unit 10*a*, the command torque corresponding to the load state of the intermediate transfer belt 31 is calculated on the basis of a signal given to the belt driving motor M3 from the driver 11, and the transfer roller driving motor M4 is subjected to the torque control by the command torque. The torque control of the roller driving unit is carried out such that the transfer roller driving motor M4 is subjected to the feedback control on the basis of information (which is a signal given to the belt driving motor M3 from the driver 11) relating to the load applied on the intermediate transfer belt 31. For this reason, the secondary transfer roller 4 comes to operate suitably to the load state applied on the intermediate transfer belt 31, so that the intermediate transfer belt 31 can be further stably driven, and the degradation in image quality can be effectively prevented.

Figure 9:
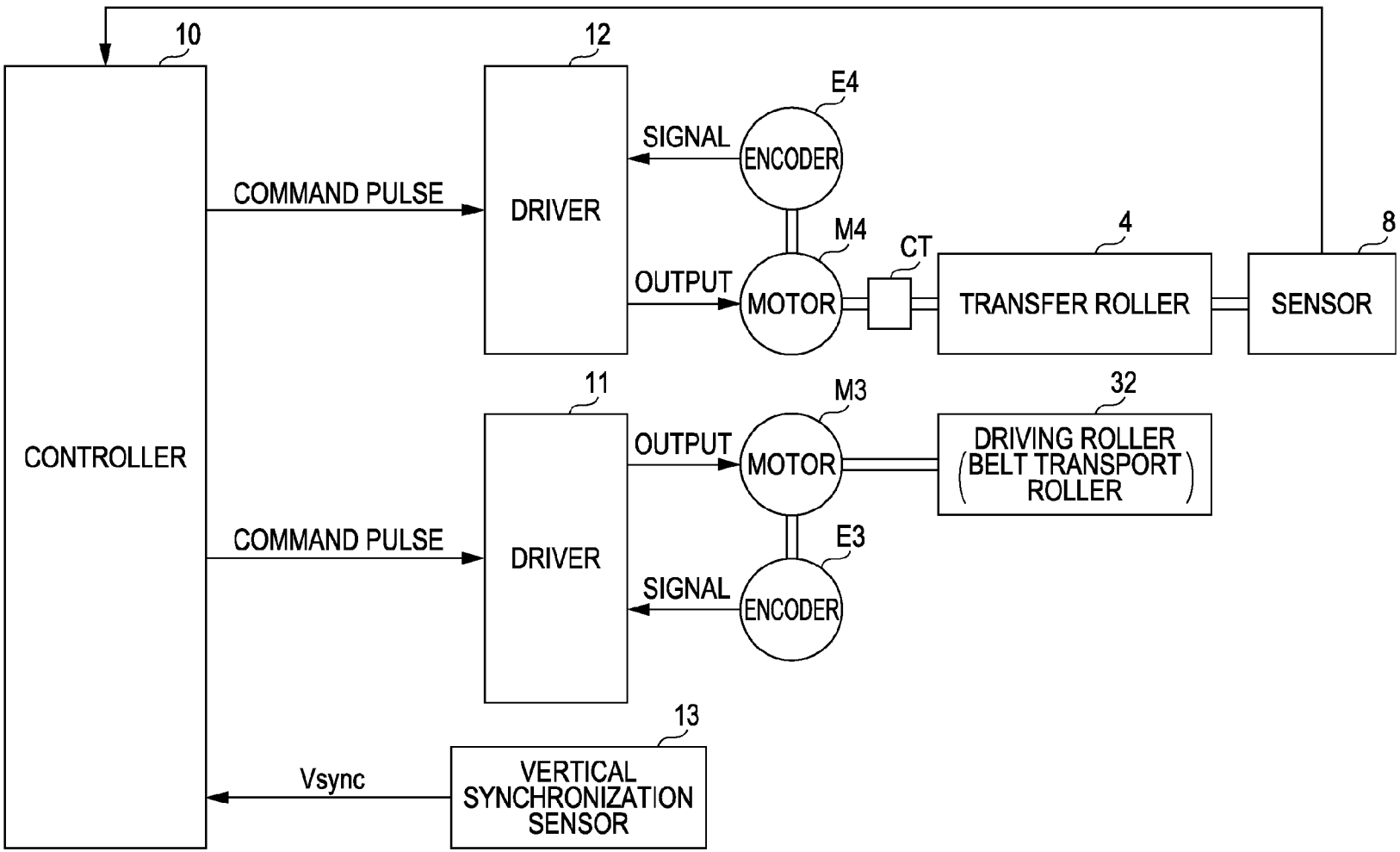
FIG. 9 is a diagram illustrating an image forming apparatus according to a second embodiment of the invention.
Figure 10:
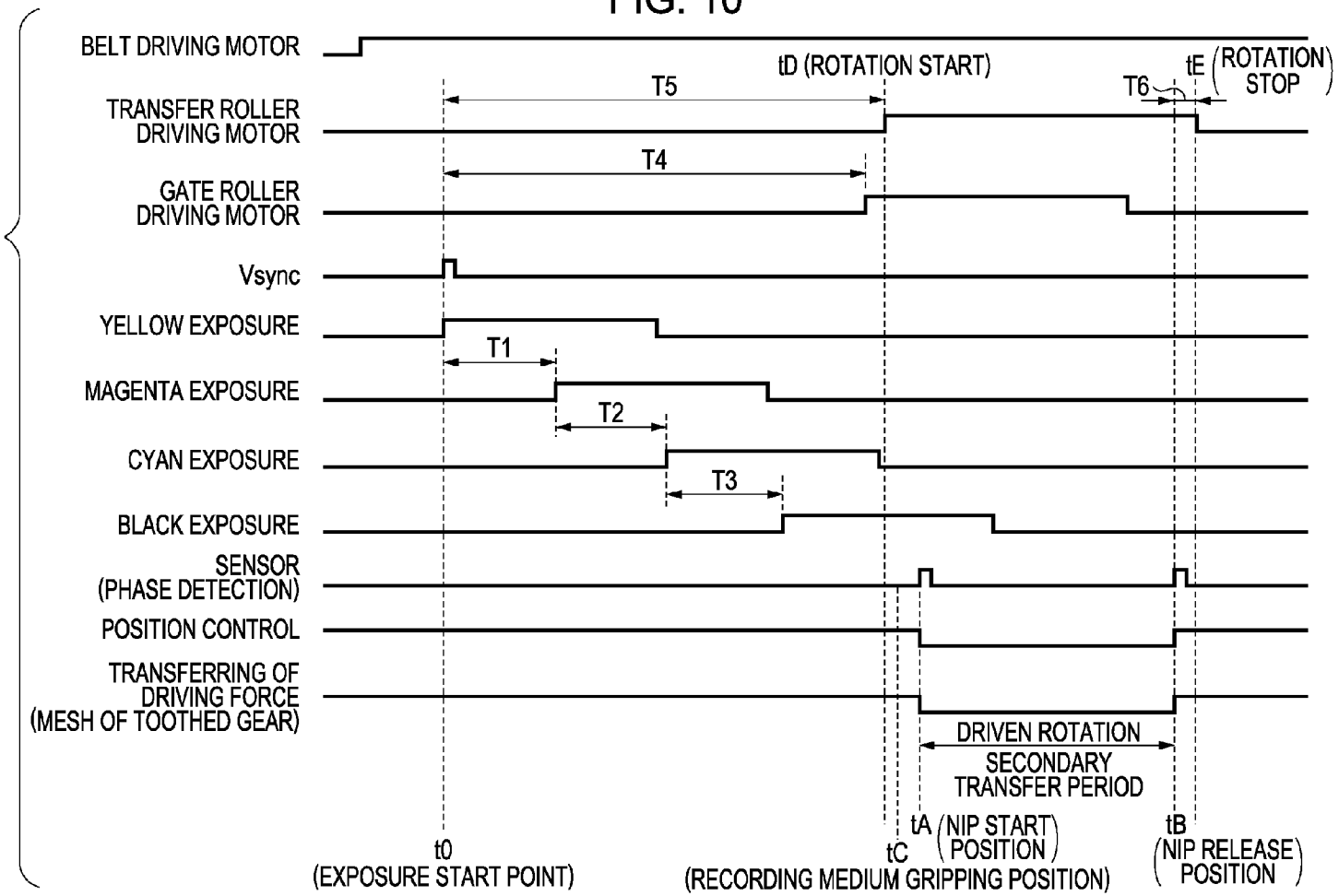
FIG. 10 is a timing chart illustrating an operational example of the image forming apparatus shown in FIG. 9.

FIG. 9 is a diagram illustrating the image forming apparatus according to the second embodiment of the invention, and FIG. 10 is a timing chart illustrating an operational example of the image forming apparatus shown in FIG. 9. The second embodiment is largely different from the first embodiment in two points. Firstly, a first point is that only a command pulse is given to the driver 12 from the controller 10, that is, only the position control is prepared as the driving control mode by the driver 12. In addition, a second point is that a one-way clutch CT is interposed between the transfer roller driving motor M4 and the secondary transfer roller 4. In the second embodiment, by providing the one-way clutch CT, while the elastic layer 43 of the secondary transfer roller 4 is facing the intermediate transfer belt 31 (from the phase A to the phase B), a driving force generated by the transfer roller driving motor M4 is blocked to be transferred to the secondary transfer roller 4, and the secondary transfer roller 4 is rotatably driven with respect to the intermediate transfer belt 31 by a frictional force between the elastic layer 43 and the nip NP of the intermediate transfer belt 31. On the other hand, while the concave portion 41 of the secondary transfer roller 4 is facing the intermediate transfer belt 31 (from the phase B to the phase A), a driving force is transferred to the secondary transfer roller 4 so as to perform the position control. Therefore, the image forming apparatus according to the second embodiment forms an image as shown in FIG. 10.

Also in the second embodiment, similarly to the first embodiment, the secondary transfer roller 4 stops in a state in which the concave portion 41 faces the intermediate transfer belt 31 wound around the driving roller 32, and waits to receive the image forming command from an external apparatus such as a host computer (see FIG. 7A). Then, when the image forming command is given to the controller 10, the belt driving motor M3 operates so as to drive the intermediate transfer belt 31, and thereafter on the basis of the timing t0 as the exposure start point in which the vertical synchronization signal Vsync is changed from the L level to the H level, the toner image is formed by each of the image forming stations 2Y, 2M, 2C and 2K, and the toner image is transferred onto the surface of the intermediate transfer belt 31.

In addition, when the time T4 lapses from the timing t0, the gate roller driving motor operates, so that the transportation of the recording medium RM onto the secondary transfer position TR2 starts. In addition, when the time T5 (>T4) lapses from the timing t0, the secondary transfer roller 4 is subjected to the position control on the basis of the command pulse output from the controller 10 so as to be delayed by a predetermined time (=T5−T4) from the gate rollers 51 and 51 and to begin to rotate in the rotation direction D4 (timing tD). Then, similarly to the first embodiment, while the secondary transfer roller 4 moves to the recording medium gripping position at the timing tC, and at the same time the tip end of the recording medium RM transported from the gate rollers 51 and 51 enters between the gripper member 442 and the gripper support member 441, and the paper biting operation starts. In addition, the controller 10 gives the gripping command to the gripper driving unit (not shown) at the same or slightly delayed time as the timing tC, and then the grip unit 44 grips the tip end of the recording medium RM.

While the tip end of the recording medium RM is gripped by the grip unit 44, the recording medium RM is transported in the rotation direction D4 together with the secondary transfer roller 4. When the secondary transfer roller 4 reaches the phase A (nip start position), the elastic layer 43 of the secondary transfer roller 4 faces the surface of the intermediate transfer belt 31 from the timing to so as to form the nip NP, and the secondary transfer roller 4 is rotatably driven with respect to the intermediate transfer belt 31. In addition, according to the rotatable driven of the secondary transfer roller 4, the recording medium RM passé through the nip NP in a state where the tip end of the recording medium RM is held on the grip unit 44, so that the secondary transfer of the toner image TI progresses. Thereafter, as in the first embodiment, the recording medium RM is transported to the fixing unit 7 via the transport mechanism 6, and the fixing of the color toner image TI is carried out onto the recording medium RM.

When the transportation of the recording medium RM from the gate rollers 51 and 51 is completed, as in the first embodiment, the controller 10 stops the rotation of the gate roller driving motor. In addition, when the secondary transfer process is completed and the secondary transfer roller 4 is in the phase B (nip release position) at the timing tB, the controller 10 stops the rotation of the transfer roller driving motor M4 at the timing tE which is a timing lapsed by a predetermined time T6 from the corresponding timing tB. Then, until the next image forming command is given to the controller 10 again so as to be driven, the motor is kept on stopping on the position of FIG. 7A.

As described above, also in the second embodiment, while the image forming is not being performed, since the concave portion 41 of the secondary transfer roller 4 faces the intermediate transfer belt 31 wound around the driving roller 32 and the elastic layer 43 is separated from the intermediate transfer belt 31, it is possible to prevent defect such as the transfer defect or the speed variation, and a good toner image TI can be transferred onto the recording medium RM. In addition, similarly to the first embodiment, it is possible to prevent toner from being attached onto the elastic layer 43 from the intermediate transfer belt 31, and contamination of recording medium RM can be prevented. Furthermore, since the secondary transfer roller 4 is rotatably driven with respect to the intermediate transfer belt 31 between the phase A to the phase B, the same operational advantage as that in the first embodiment in which the torque control is performed in the corresponding period (phase A to phase B) can be obtained.

Figures 11A, 11B, 11C:
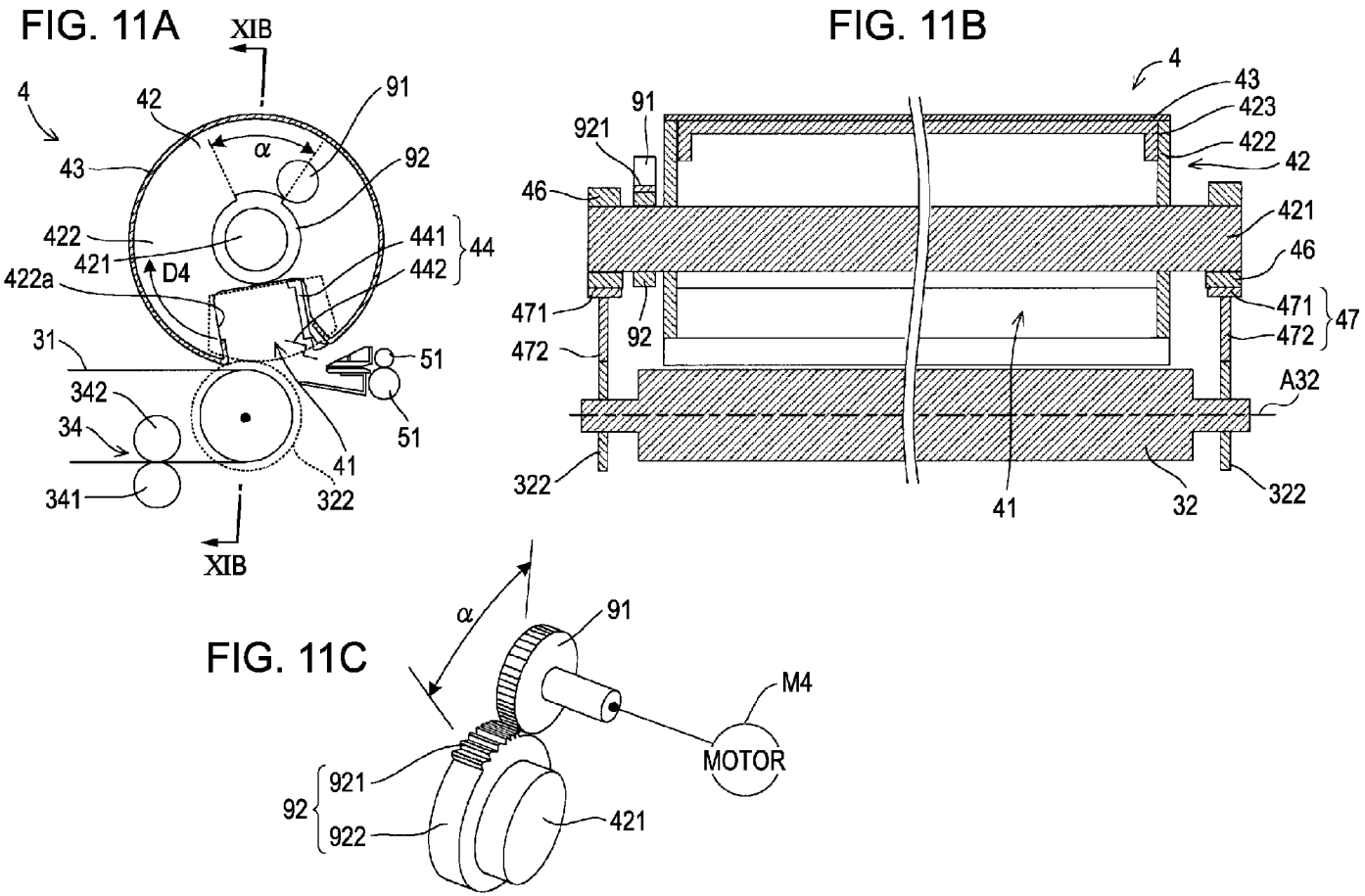
FIGS. 11*a* to 11*c* are diagrams illustrating an image forming apparatus according to a third embodiment of the invention.

FIG. 11 is a diagram illustrating the image forming apparatus according to the third embodiment of the invention. The third embodiment is different from the first embodiment in that the controller 10 gives only the command pulse to the driver 12, that is, only the position control is prepared as the driving control mode by the driver 12, and in that a driving force generated by the transfer roller driving motor M4 is transferred to the secondary transfer roller 4 via toothed gears 91 and 92. The toothed gear 91 on the motor side among the toothed gears is a spur gear in which a toothed gear portion is formed over the entire peripheral surface, and the toothed gear 92 is a partially toothed gear which includes a toothed gear portion 921 meshed with the toothed gear 91 and a partially toothed gear portion 922 which is not meshed with the toothed gear 91. In the third embodiment, the toothed gear portion 921 is formed in correspondence with an angle range $\alpha$ (63° in this embodiment). The partially toothed gear 92 is attached to the end of the rotation shaft 421 such that when the secondary transfer roller 4 is in the phase B, the toothed gear portion 921 in the rotation direction D4 begins to be meshed with the toothed gear 91, and when the secondary transfer roller 4 is in the phase A, the toothed gear portion 921 in the rotation direction D4 is separated from the toothed gear 91. Therefore, only while the secondary transfer roller 4 is being between the phase B (nip release position) and the phase A (nip start position), a driving force generated by the transfer roller driving motor M4 is transferred to the secondary transfer roller 4 via the toothed gears 91 and 92. On the other hand, while the elastic layer 43 of the secondary transfer roller 4 is facing the intermediate transfer belt 31 (from phase A to the phase B), a driving force generated by the transfer roller driving motor M4 is not transferred to the secondary transfer roller 4, and the secondary transfer roller 4 is rotatably driven by a frictional force in the nip NP between the elastic layer 43 and the intermediate transfer belt 31 with respect to the intermediate transfer belt 31. Therefore, in the third embodiment, the image forming is carried out exactly similar to the second embodiment (see FIG. 10). Accordingly, also in the third embodiment, the same operational advantage as the second embodiment can be obtained.

Figure 12:
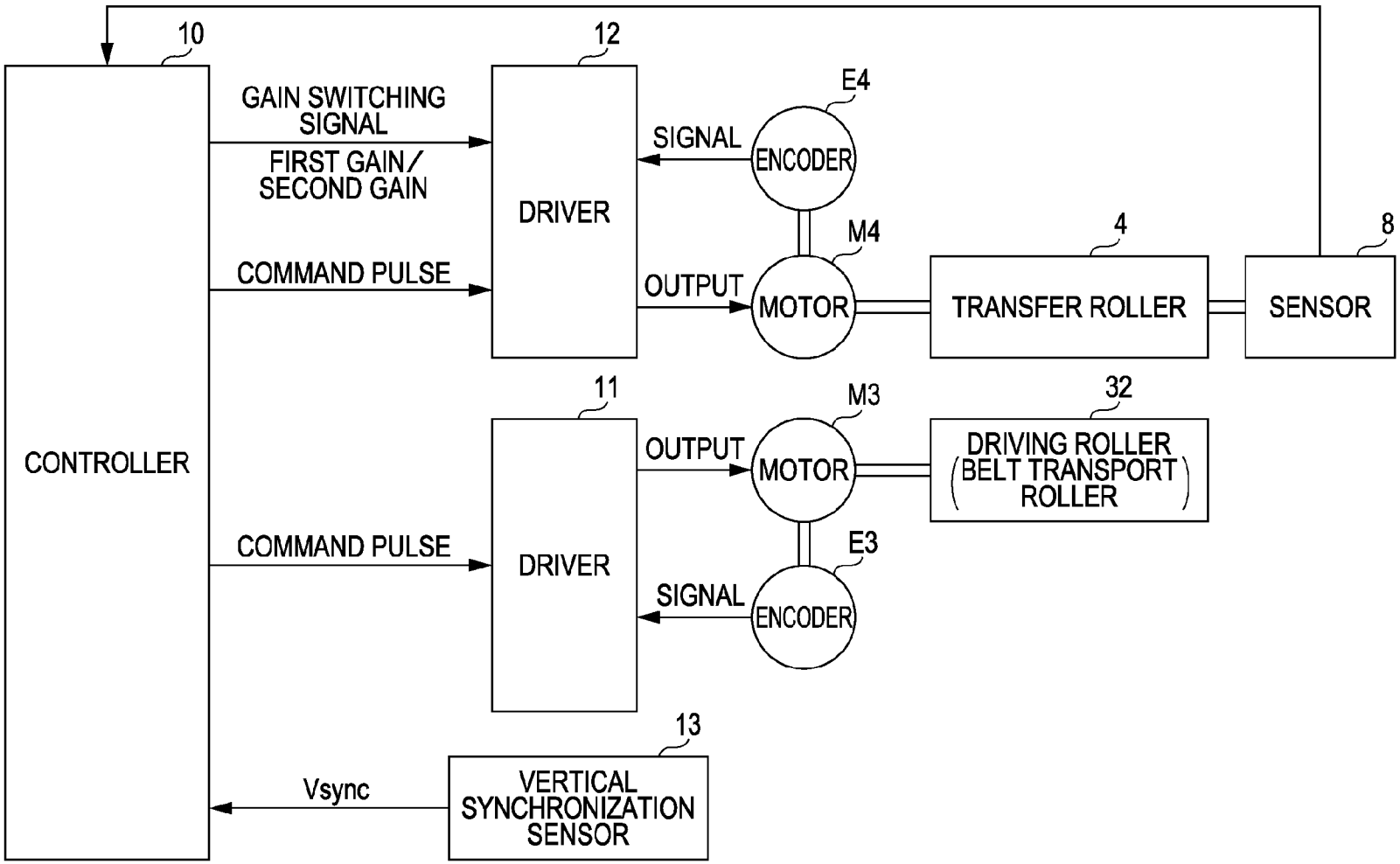
FIG. 12 is a diagram illustrating an image forming apparatus according to a fourth embodiment of the invention.

FIG. 12 is a diagram illustrating the image forming apparatus according to the fourth embodiment of the invention. The fourth embodiment is largely different from the first embodiment in two points. Firstly, a first point is that only a command pulse is given to the driver 12 from the controller 10, that is, only the position control is prepared as the driving control mode by the driver 12. In addition, a second point is that a gain switching signal is given to the driver 12 so that a position control gain can be switched in two steps. In the fourth embodiment, regardless of the phase of the secondary transfer roller 4, the motor M4 is subjected to the position control according to the command pulse, and the position control gain is switched as follows. That is, while the concave portion 41 of the secondary transfer roller 4 is facing the intermediate transfer belt 31 (from the phase B to the phase A), the position control gain is set to a first gain which is comparatively large so as to position the secondary transfer roller 4 with high accuracy. On the other hand, while the elastic layer 43 of the secondary transfer roller 4 is facing the intermediate transfer belt 31 (from the phase A to the phase B), the position control gain is set to a second gain which is smaller than the first gain so as to suppress the change in the load applied on the intermediate transfer belt 31 compared with the case where the position control is carried out with the first gain as described above.

Figure 13:
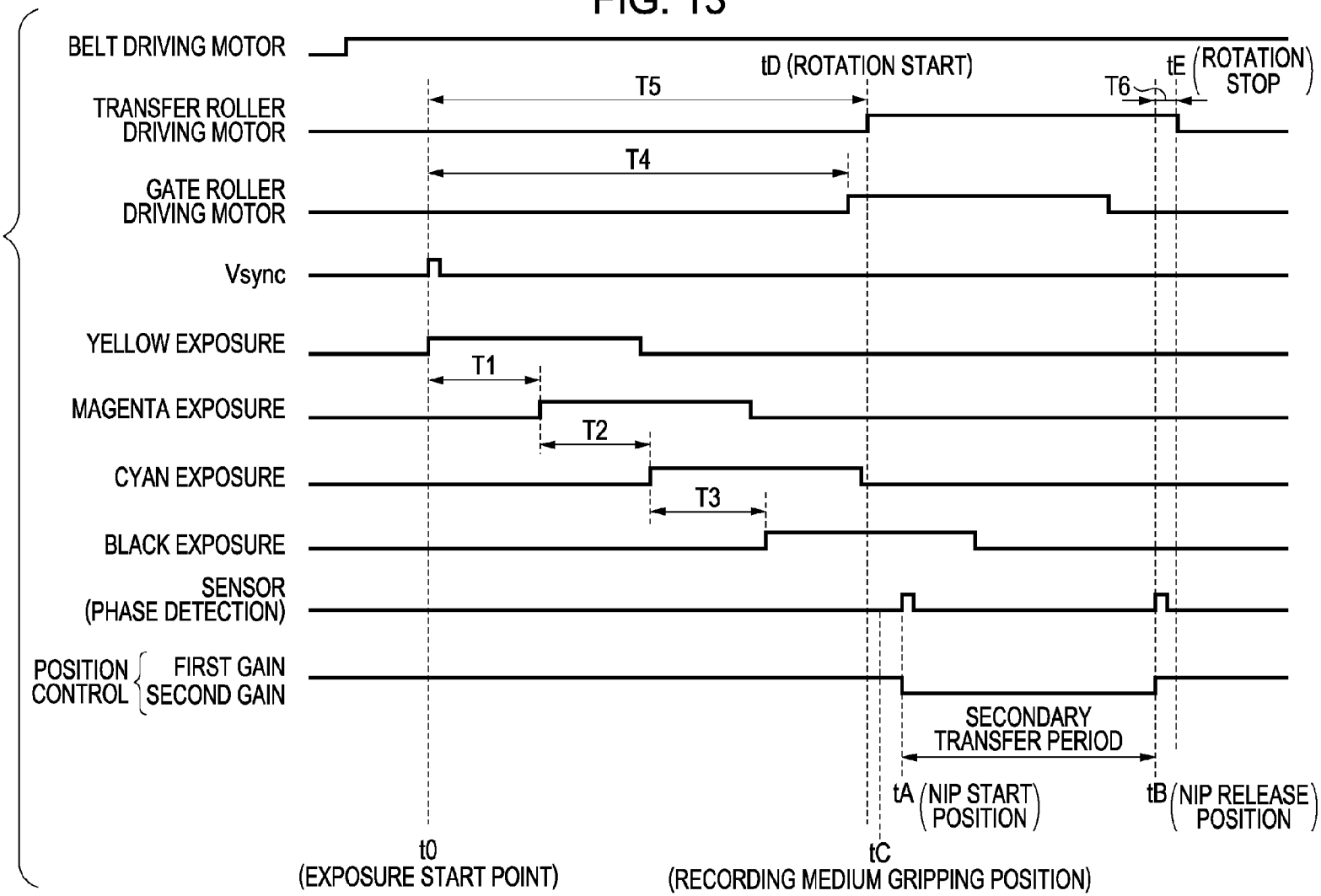
FIG. 13 is a timing chart illustrating an operation of the image forming apparatus shown in FIG. 12.

FIG. 13 is a timing chart illustrating the operational example of the image forming apparatus shown in FIG. 12. Also in the fourth embodiment, similarly to the first embodiment, the secondary transfer roller 4 stops in a state in which the concave portion 41 faces the intermediate transfer belt 31 which is wound around the driving roller 32, and waits to receive the image forming command from an external apparatus such as a host computer (see FIG. 7A). Then, when the image forming command on forming a color image from an external apparatus such as a host computer is given to the controller 10, the belt driving motor M3 operates so as to drive the intermediate transfer belt 31, and the controller 10 detects that the vertical synchronization signal Vsync is changed from the L level to the H level at the timing t0. Then, the timing t0 is set as the exposure start point, similar to the first embodiment, the controller forms the toner image by each of the image forming stations 2Y, 2M, 2C and 2K, and primarily transfers the toner image on the surface of the intermediate transfer belt 31.

In addition, when the time T4 lapses from the timing t0, the gate roller driving motor operates, so that the transportation of the recording medium RM onto the secondary transfer position TR2 starts. In addition, when time T5 (>T4) lapses from the timing t0, the secondary transfer roller 4 is subjected to the position control on the basis of the command pulse output from the controller 10 so as to be delayed by a predetermined time (=T5−T4) from the gate rollers 51 and 51 and to begin to rotate in the rotation direction D4 (timing tD). Further, in this embodiment, while the concave portion 41 is facing to the intermediate transfer belt 31 wound around the driving roller 32, the controller 10 sets a corresponding position control gain to a first gain which is comparatively large by a gain switching signal, and until it comes into the phase A, the controller 10 prompts the driver 12 to be subjected to the position control with the first gain.

As described above, while the position control is performed with the first gain, the tip end of the recording medium RM transported from the gate rollers 51 and 51 enters between the gripper member 442 and the gripper support member 441 at the same time when the secondary transfer roller 4 moves on the recording medium gripping position at the timing tC, and the paper biting operation starts. In addition, the controller 10 gives a gripping command to a gripper driving unit (not shown) at the same or slightly delayed time as the timing tC, so that the tip end of the recording medium RM is gripped by the grip unit 44.

The recording medium RM is transported in the rotation direction D4 together with the secondary transfer roller 4 in a state in which the tip end thereof is gripped by the grip unit 44. Then, when the secondary transfer roller 4 reaches the phase A (nip start position) (timing tA), the elastic layer 43 faces the intermediate transfer belt 31 so as to form the nip NP. Then, the controller 10 sets the corresponding position control gain to the second gain by the gain switching signal so as to suppress the variation in load applied on the intermediate transfer belt 31. In addition, the recording medium RM passes through the nip NP in a state in which the tip end thereof is held on the grip unit 44 in accordance with the rotation of the secondary transfer roller 4, so that the secondary transfer of the toner image TI progresses. Thereafter, similarly to the first embodiment, the recording medium RM is transported to the fixing unit 7 via the transport mechanism 6, and the fixing of a color toner image TI is performed onto the recording medium RM.

When the transportation of the recording medium RM from the gate rollers 51 and 51 is completed, as in the first embodiment, the controller 10 stops the rotation of the gate roller driving motor. In addition, when the secondary transfer process is completed and the secondary transfer roller 4 is in the phase B (nip release position) at the timing tB, the controller 10 stops the rotation of the transfer roller driving motor M4 at the timing tE which is a timing lapsed by a predetermined time T6 from the corresponding timing tB. Then, until the next image forming command is given to the controller 10 again so as to be driven, the motor is kept on stopping on the position of FIG. 7A.

As described above, also in the fourth embodiment, as in the first embodiment, while the image forming is not being performed, since the concave portion 41 of the secondary transfer roller 4 faces the intermediate transfer belt 31 wound around the driving roller 32 and the elastic layer 43 is separated from the intermediate transfer belt 31, it is possible to prevent defect such as the transfer defect or the speed variation, and a good toner image TI can be transferred onto the recording medium RM. In addition, similarly to the first embodiment, it is possible to prevent toner from being attached onto the elastic layer 43 from the intermediate transfer belt 31, and contamination of recording medium RM can be prevented.

In addition, since the position control gain is large while the concave portion 41 is facing the intermediate transfer belt 31, the secondary transfer roller 4 can be accurately positioned on the recording medium gripping position, and the recording medium RM can be securely gripped by the grip unit 44. On the other hand, while the elastic layer 43 is facing the intermediate transfer belt 31 so as to form the nip NP and to carry out the secondary transfer process, that is, before the secondary transfer roller 4 reaches the phase B (nip release position) from the phase A (nip start position), since the secondary transfer roller 4 is subjected to the position control with the comparatively small second gain, the change in the load applied on the intermediate transfer belt 31 can be suppressed, and the intermediate transfer belt 31 can be stably driven. As a result, the degradation in image quality caused by the speed change of the intermediate transfer belt 31 can be effectively prevented.

Figure 14A:
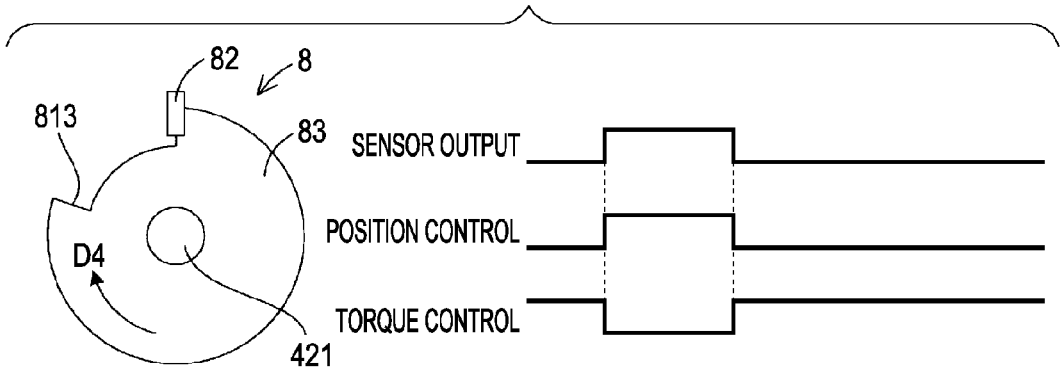
FIGS. 14A to 14C are diagrams illustrating an image forming apparatus according to another embodiment of the invention.

Further, the invention is not limited to the above-mentioned embodiments, but various changes other than the above-mentioned embodiment can be made without departing from the main points thereof. For example, in the above-mentioned embodiments, the description has been made such that the phase detecting sensor 8 is configured to include the slit plate 81 having two slits 811 and 812 and the sensor element 82, but the configuration of the phase detecting sensor 8 is not limited thereto. For example, as shown in FIG. 14A, instead of the slit plate 81, a disk-shape member 83 which is provided with a notched portion 813 over an angle range $\alpha$ in which the concave portion 41 faces the intermediate transfer belt 31. In the phase detecting sensor 8 as configured above, when the secondary transfer roller 4 is in the phase B (nip release position), the downstream end of the notched portion 813 in the rotation direction D4 passes through the sensor element 82, so that the sensor output is changed from the L level to the H level. In addition, when the secondary transfer roller 4 is in the phase A (nip start position), the upstream end of the notched portion 813 passes through the sensor element 82, so that the sensor output is changed from the H level to the L level. As described above, the phase A and phase B are detected on the basis of the output level, and similarly to the above-mentioned embodiments the driving control mode of the transfer roller driving motor M4 by the driver 12 is switched between the torque control and the position control.

Figure 14B:
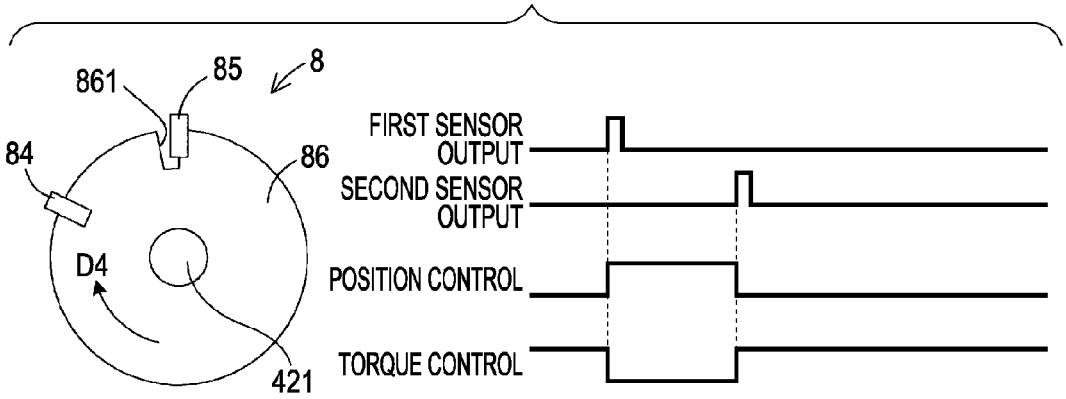

In addition, in the phase detecting sensor 8 shown in FIG. 14B, two sensor elements 84 and 85 and one slit plate 86 are provided. The sensor elements 84 and 85 are disposed such that an angle from the first sensor element 84 to the second sensor element 85 is matched with the angle range $\alpha$ along the rotation direction D4. In addition, the slit plate 86 is provided with one slit 861, and the slit plate 86 rotates in the rotation direction D4 together with the rotation shaft 421. Then, when the secondary transfer roller 4 is in the phase B (nip release position), the slit 861 passes through the first sensor element 84, so that the output of the first sensor element 84 is changed from the L level to the H level. Furthermore, when the secondary transfer roller 4 is in the phase A (nip start position), the slit 861 passes through the second sensor element 85, so that the output of the second sensor element 85 is changed from the L level to the H level. As described above, the phase A and phase B are detected on the basis of the output level, and similarly to the above-mentioned embodiments the driving control mode of the transfer roller driving motor M4 by the driver 12 is switched between the torque control and the position control.

Figure 14C:
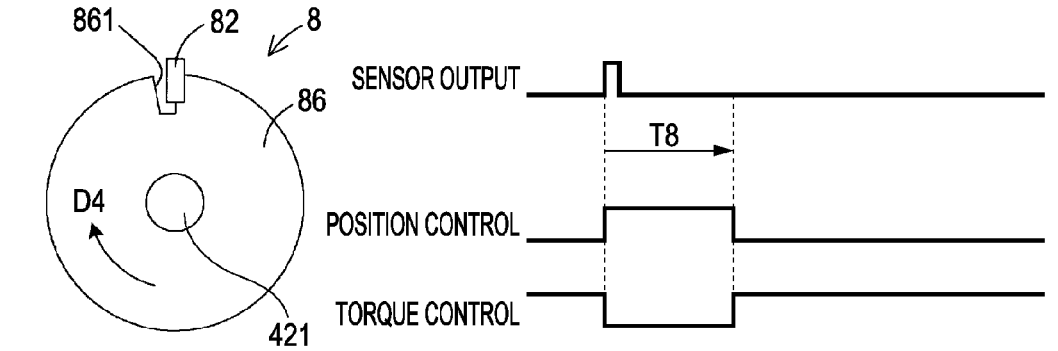

In addition, in the phase detecting sensor 8 shown in FIG. 14C, the sensor element 82 and the slit plate 86 are provided, and when the secondary transfer roller 4 is in the phase B (nip release position), the slit 861 passes through the sensor element 82, so that the output of the sensor element 82 is changed from the L level to the H level. Then, the controller 10 starts time measurement by being triggered by the change in the output level, and when a lapsed time reaches a predetermined time T8 (which is a time necessary for the secondary transfer roller 4 to reach the phase A from the phase B), it may detect that the secondary transfer roller 4 is in the phase A (nip start position). As described above, by assembling the time measurements of the phase detecting sensor 8 and the controller 10, the phase A and the phase B are detected, and similarly to the above-mentioned embodiments the driving control mode of the transfer roller driving motor M4 by the driver 12 is switched between the torque control and the position control.

Furthermore, in the above-mentioned embodiments, the invention is applied to the image forming apparatus which secondarily transfers the toner image formed on the surface of the intermediate transfer belt 31 onto the recording medium RM, but the invention may be applied to an image forming apparatus which secondarily transfers the toner image formed on an intermediate transfer drum onto the recording medium, or to an image forming apparatus which transfers the toner image formed on a photosensitive body onto the recording medium.

The entire disclosure of Japanese Patent Application No: 2009-97978, filed Apr. 14, 2009 is expressly incorporated by reference herein.

What is claimed is:

1. An image forming apparatus comprising:

an image carrier that carries an image;

a transfer roller that includes a roller base material, a concave portion that is provided on a peripheral surface of the roller base material, a grip unit that is disposed in the concave portion and grips a recording medium, and an elastic layer that is disposed on a peripheral surface of the roller base material, the transfer roller passing the recording medium through a nip which is formed between the image carrier and the elastic layer that comes into contact with the image carrier via the image carrier and the recording medium so as to transfer the image carried on the image carrier onto the recording medium;

a roller driving unit that rotates the roller base material; and a control unit that controls the roller driving unit and causes the concave portion to face the image carrier so as to stop the transfer roller.

2. The image forming apparatus according to claim 1, wherein the opening width of the concave portion in a rotation direction of the transfer roller is wider than that in the rotation direction of the nip.

3. The image forming apparatus according to claim 1, wherein after the transported recording medium is gripped by the grip unit, the transfer roller passes the recording medium through the nip so as to transfer the image carried on the image carrier onto the recording medium, and wherein after the recording medium starts to be transported to the transfer roller, the control unit starts to rotate the transfer roller.

4. The image forming apparatus according to claim 3, wherein the control unit determines the timing for stopping the transfer roller on the basis of starting of the butting member to come into contact with the belt tension roller.

5. The image forming apparatus according to claim 1, wherein when the transfer roller stops, the concave portion is positioned on the upstream side in the rotation direction with respect to the recording medium gripping position in which the recording medium is gripped.

6. The image forming apparatus according to claim 1, wherein the image carrier is a transfer belt that is wound around a belt tension roller, wherein the transfer roller includes a butting member that rotates together with the roller base material, and wherein the butting member comes into contact with the belt tension roller while the concave portion faces the transfer belt and is separated from the belt tension roller while the nip is formed.

7. An image forming method comprising the steps of:

rotating a roller member while facing an image carrier which is driven while carrying an image;

gripping a recording medium by a grip unit that is disposed in a concave portion while the concave portion provided on a peripheral surface of the roller base material faces the image carrier;

transferring the image carried on the image carrier onto the recording medium by passing the recording medium through a nip while causing an elastic layer disposed on a peripheral surface of the roller base material to come into contact with the image carrier so as to form the nip between the image carrier and the elastic layer; and causing the concave portion to face the image carrier so as to stop the transfer roller after the image is transferred onto the recording medium.

* * * * *